US008944161B2

(12) United States Patent
Bloom et al.

(10) Patent No.: US 8,944,161 B2
(45) **Date of Patent: *Feb. 3, 2015**

(54) GRIPPER ASSEMBLY FOR DOWNHOLE TOOLS

(71) Applicant: WWT North America Holdings, Inc., Houston, TX (US)

(72) Inventors: Duane Bloom, Anaheim, CA (US); Norman Bruce Moore, Aliso Viejo, CA (US); Rudolph Ernst Krueger, V, Newport Beach, CA (US)

(73) Assignee: WWT North America Holdings, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/047,415

(22) Filed: Oct. 7, 2013

(65) Prior Publication Data

US 2014/0166369 A1 Jun. 19, 2014

Related U.S. Application Data

(63) Continuation of application No. 13/300,452, filed on Nov. 18, 2011, now Pat. No. 8,555,963, which is a continuation of application No. 12/572,916, filed on Oct. 2, 2009, now Pat. No. 8,069,917, which is a (Continued)

(51) Int. Cl.

| | |
|---|---|
| ***E21B 23/01*** | (2006.01) |
| ***E21B 4/18*** | (2006.01) |
| ***E21B 19/22*** | (2006.01) |
| ***E21B 23/00*** | (2006.01) |
| ***E21B 23/04*** | (2006.01) |

(52) U.S. Cl.

CPC . *E21B 23/01* (2013.01); *E21B 4/18* (2013.01); *E21B 19/22* (2013.01); *E21B 23/00* (2013.01); *E21B 23/04* (2013.01); *E21B 2023/008* (2013.01)

USPC ..... 166/212; 166/213; 166/217; 175/99; 175/230

(58) Field of Classification Search

USPC ..... 166/217, 213, 50, 212, 382, 206; 175/98, 99, 230

See application file for complete search history.

(56) References Cited

U.S. PATENT DOCUMENTS

| | | | |
|---|---|---|---|
| 2,141,030 | A | 12/1938 | Clark |
| 2,167,194 | A | 7/1939 | Anderson |

(Continued)

FOREIGN PATENT DOCUMENTS

| | | |
|---|---|---|
| AU | 2002-230623 | 7/2007 |
| AU | 2004-4210989 | 3/2009 |

(Continued)

OTHER PUBLICATIONS

"Kilobomac to Challenge Tradition" Norwegian Oil Review, 1988, pp. 50-52.

*Primary Examiner* — Daniel P Stephenson

(74) *Attorney, Agent, or Firm* — Knobbe Martens Olson and Bear LLP

(57) ABSTRACT

A gripper assembly for anchoring a tool within a downhole passage and for possibly assisting movement of the tool within the passage. The gripper assembly includes an elongated mandrel and flexible toes that can be radially displaced to grip onto the surface of the passage. The toes are displaced by the interaction of a driver slidable on the mandrel and a driver interaction element on the toes. In one embodiment, the toes are displaced by the interaction of rollers and ramps that are longitudinally movable with respect to one another. In another embodiment, the toes are displaced by the interaction of toggles that rotate with respect to the toes.

13 Claims, 18 Drawing Sheets

Related U.S. Application Data continuation of application No. 11/865,676, filed on Oct. 1, 2007, now Pat. No. 7,604,060, which is a continuation of application No. 11/418,449, filed on May 3, 2006, now Pat. No. 7,275,593, which is a continuation of application No. 10/690,054, filed on Oct. 21, 2003, now Pat. No. 7,048,047, which is a continuation of application No. 10/268,604, filed on Oct. 9, 2002, now Pat. No. 6,640,894, which is a continuation of application No. 09/777,421, filed on Feb. 6, 2001, now Pat. No. 6,464,003.

(60) Provisional application No. 60/205,937, filed on May 18, 2000, provisional application No. 60/228,918, filed on Aug. 29, 2000.

(56) References Cited

U.S. PATENT DOCUMENTS

| | | | |
|---|---|---|---|
| 2,271,005 | A | 1/1942 | Grebe |
| 2,569,457 | A | 10/1951 | Dale et al. |
| 2,727,722 | A | 12/1955 | Conboy |
| 2,783,028 | A | 2/1957 | Jamison |
| 2,946,565 | A | 7/1960 | Williams |
| 2,946,578 | A | 7/1960 | De Smaele |
| 3,138,214 | A | 6/1964 | Bridwell |
| 3,180,436 | A | 4/1965 | Kellner et al. |
| 3,180,437 | A | 4/1965 | Kellner et al. |
| 3,185,225 | A | 5/1965 | Ginies |
| 3,224,513 | A | 12/1965 | Weeden, Jr. |
| 3,224,734 | A | 12/1965 | Hill |
| 3,225,843 | A | 12/1965 | Ortloff et al. |
| 3,376,942 | A | 4/1968 | Van Winkle |
| 3,497,019 | A | 2/1970 | Ortloff |
| 3,599,712 | A | 8/1971 | Magill |
| 3,606,924 | A | 9/1971 | Malone |
| 3,661,205 | A | 5/1972 | Belorgey |
| 3,664,416 | A | 5/1972 | Nicolas et al. |
| 3,797,589 | A | 3/1974 | Kellner et al. |
| 3,827,512 | A | 8/1974 | Edmond |
| RE28,449 | E | 6/1975 | Edmond |
| 3,941,190 | A | 3/1976 | Conover |
| 3,978,930 | A | 9/1976 | Schroeder |
| 3,992,565 | A | 11/1976 | Gatfield |
| 4,040,494 | A | 8/1977 | Kellner |
| 4,085,808 | A | 4/1978 | Kling |
| 4,095,655 | A | 6/1978 | Still |
| 4,141,414 | A | 2/1979 | Johansson |
| 4,184,546 | A | 1/1980 | Nicolas et al. |
| 4,274,758 | A | 6/1981 | Schosek |
| 4,314,615 | A | 2/1982 | Sodder, Jr. et al. |
| 4,365,676 | A | 12/1982 | Boyadjieff et al. |
| 4,372,161 | A | 2/1983 | de Buda et al. |
| 4,385,021 | A | 5/1983 | Neeley |
| 4,440,239 | A | 4/1984 | Evans |
| 4,463,814 | A | 8/1984 | Horstmeyer et al. |
| 4,558,751 | A | 12/1985 | Huffaker |
| 4,573,537 | A | 3/1986 | Hirasuna et al. |
| 4,615,401 | A | 10/1986 | Garrett |
| 4,674,914 | A | 6/1987 | Wayman et al. |
| 4,686,653 | A | 8/1987 | Staron et al. |
| 4,811,785 | A | 3/1989 | Weber |
| 4,821,817 | A | 4/1989 | Cendre et al. |
| 4,854,397 | A | 8/1989 | Warren et al. |
| 4,926,937 | A | 5/1990 | Hademenos |
| 4,951,760 | A | 8/1990 | Cendre et al. |
| 5,010,965 | A | 4/1991 | Schmelzer |
| 5,052,211 | A | 10/1991 | Cohrs et al. |
| 5,090,259 | A | 2/1992 | Shishido et al. |
| 5,169,264 | A | 12/1992 | Kimura |
| 5,184,676 | A | 2/1993 | Graham et al. |
| 5,186,264 | A | 2/1993 | du Chaffaut |
| 5,203,646 | A | 4/1993 | Landsberger et al. |
| 5,310,012 | A | 5/1994 | Cendre et al. |
| 5,316,094 | A | 5/1994 | Pringle et al. |
| 5,358,039 | A | 10/1994 | Fordham |
| 5,358,040 | A | 10/1994 | Kinley et al. |
| 5,363,929 | A | 11/1994 | Williams et al. |
| 5,394,951 | A | 3/1995 | Pringle et al. |
| 5,419,405 | A | 5/1995 | Patton |
| 5,425,429 | A | 6/1995 | Thompson |
| 5,449,047 | A | 9/1995 | Schivley, Jr. |
| 5,467,832 | A | 11/1995 | Orban et al. |
| 5,494,111 | A | 2/1996 | Davis |
| 5,519,668 | A | 5/1996 | Montaron |
| 5,542,253 | A | 8/1996 | Ganzel |
| 5,613,568 | A | 3/1997 | Sterner et al. |
| 5,622,231 | A | 4/1997 | Thompson |
| 5,752,572 | A | 5/1998 | Baiden et al. |
| 5,758,731 | A | 6/1998 | Zollinger |
| 5,758,732 | A | 6/1998 | Liw |
| 5,765,640 | A | 6/1998 | Milne et al. |
| 5,794,703 | A | 8/1998 | Newman et al. |
| 5,803,193 | A | 9/1998 | Krueger et al. |
| 5,845,796 | A | 12/1998 | Miller |
| 5,857,731 | A | 1/1999 | Heim et al. |
| 5,947,213 | A | 9/1999 | Angle et al. |
| 5,954,131 | A | 9/1999 | Sallwasser |
| 5,960,895 | A | 10/1999 | Chevallier et al. |
| 5,996,979 | A | 12/1999 | Hrsuch |
| 6,003,606 | A | 12/1999 | Moore et al. |
| 6,026,911 | A | 2/2000 | Angle et al. |
| 6,031,371 | A | 2/2000 | Smart |
| 6,082,461 | A | 7/2000 | Newman |
| 6,089,323 | A | 7/2000 | Newman et al. |
| 6,112,809 | A | 9/2000 | Angle |
| 6,216,779 | B1 | 4/2001 | Reinhardt |
| 6,230,813 | B1 | 5/2001 | Moore et al. |
| 6,232,773 | B1 | 5/2001 | Jacobs et al. |
| 6,241,031 | B1 | 6/2001 | Beaufort et al. |
| 6,273,189 | B1 | 8/2001 | Gissler et al. |
| 6,286,592 | B1 | 9/2001 | Moore et al. |
| 6,315,043 | B1 | 11/2001 | Farrant et al. |
| 6,345,669 | B1 | 2/2002 | Buyers et al. |
| 6,347,674 | B1 | 2/2002 | Bloom et al. |
| 6,378,627 | B1 | 4/2002 | Tubel et al. |
| 6,427,786 | B2 | 8/2002 | Beaufort et al. |
| 6,431,270 | B1 | 8/2002 | Angle |
| 6,431,291 | B1 | 8/2002 | Moore et al. |
| 6,464,003 | B2 | 10/2002 | Bloom et al. |
| 6,478,097 | B2 | 11/2002 | Bloom et al. |
| 6,601,652 | B1 | 8/2003 | Moore et al. |
| 6,609,579 | B2 | 8/2003 | Krueger et al. |
| 6,629,568 | B2 | 10/2003 | Post et al. |
| 6,640,894 | B2 | 11/2003 | Bloom et al. |
| 6,651,747 | B2 | 11/2003 | Chen et al. |
| 6,679,341 | B2 | 1/2004 | Bloom et al. |
| 6,712,134 | B2 | 3/2004 | Stoesz |
| 6,715,559 | B2 | 4/2004 | Bloom et al. |
| 6,722,442 | B2 | 4/2004 | Simpson |
| 6,745,854 | B2 | 6/2004 | Bloom et al. |
| 6,758,279 | B2 | 7/2004 | Moore et al. |
| 6,796,380 | B2 | 9/2004 | Xu |
| 6,827,149 | B2 | 12/2004 | Hache |
| 6,868,906 | B1 | 3/2005 | Vail, III et al. |
| 6,910,533 | B2 | 6/2005 | Guerrero |
| 6,920,936 | B2 | 7/2005 | Sheiretov et al. |
| 6,935,423 | B2 | 8/2005 | Kusmer |
| 6,938,708 | B2 | 9/2005 | Bloom et al. |
| 6,953,086 | B2 | 10/2005 | Simpson |
| 7,048,047 | B2 | 5/2006 | Bloom et al. |
| 7,059,417 | B2 | 6/2006 | Moore et al. |
| 7,080,700 | B2 | 7/2006 | Bloom et al. |
| 7,080,701 | B2 | 7/2006 | Bloom et al. |
| 7,090,007 | B2 | 8/2006 | Stuart-Bruges et al. |
| 7,121,364 | B2 | 10/2006 | Mock et al. |
| 7,143,843 | B2 | 12/2006 | Doering et al. |
| 7,156,181 | B2 | 1/2007 | Moore et al. |
| 7,156,192 | B2 | 1/2007 | Guerrero et al. |
| 7,172,026 | B2 | 2/2007 | Misselbrook |
| 7,174,974 | B2 | 2/2007 | Bloom et al. |
| 7,185,716 | B2 | 3/2007 | Bloom et al. |
| 7,188,681 | B2 | 3/2007 | Bloom et al. |
| 7,191,829 | B2 | 3/2007 | Bloom et al. |

(56) References Cited

U.S. PATENT DOCUMENTS

| | | | |
|---|---|---|---|
| 7,215,253 | B2 | 5/2007 | Baek et al. |
| 7,222,682 | B2 | 5/2007 | Doering et al. |
| 7,273,109 | B2 | 9/2007 | Moore et al. |
| 7,275,593 | B2 | 10/2007 | Bloom et al. |
| 7,303,010 | B2 | 12/2007 | de Guzman et al. |
| 7,334,642 | B2 | 2/2008 | Doering et al. |
| 7,337,850 | B2 | 3/2008 | Contant |
| 7,343,982 | B2 | 3/2008 | Mock et al. |
| 7,353,886 | B2 | 4/2008 | Bloom et al. |
| 7,392,859 | B2 | 7/2008 | Mock et al. |
| 7,401,665 | B2 | 7/2008 | Guerrero et al. |
| 7,493,967 | B2 | 2/2009 | Mock et al. |
| 7,516,782 | B2 | 4/2009 | Sheiretov et al. |
| 7,516,792 | B2 | 4/2009 | Lonnes et al. |
| 7,604,060 | B2 | 10/2009 | Bloom et al. |
| 7,607,495 | B2 | 10/2009 | Bloom et al. |
| 7,607,497 | B2 | 10/2009 | Mock et al. |
| 7,624,808 | B2 | 12/2009 | Mock |
| 7,743,849 | B2 | 6/2010 | Kotsonis et al. |
| 7,748,476 | B2 | 7/2010 | Krueger, V |
| 7,770,667 | B2 | 8/2010 | Moore |
| 7,775,272 | B2 | 8/2010 | Nelson et al. |
| 7,784,564 | B2 | 8/2010 | Iskander et al. |
| 7,832,488 | B2 | 11/2010 | Guerrero et al. |
| 7,836,950 | B2 | 11/2010 | Vail, III et al. |
| 7,854,258 | B2 | 12/2010 | Sheiretov et al. |
| 7,857,067 | B2 | 12/2010 | Tunc et al. |
| 7,886,834 | B2 | 2/2011 | Spencer et al. |
| 7,896,088 | B2 | 3/2011 | Guerrero et al. |
| 7,900,699 | B2 | 3/2011 | Ramos et al. |
| 7,954,562 | B2 | 6/2011 | Mock |
| 7,954,563 | B2 | 6/2011 | Mock et al. |
| 8,061,447 | B2 | 11/2011 | Krueger |
| 8,069,917 | B2 | 12/2011 | Bloom et al. |
| 8,082,988 | B2 | 12/2011 | Redlinger et al. |
| 8,151,902 | B2 | 4/2012 | Lynde et al. |
| 8,245,796 | B2 | 8/2012 | Mock et al. |
| 8,286,716 | B2 | 10/2012 | Martinez et al. |
| 8,485,278 | B2 | 7/2013 | Mock |
| 2001/0045300 | A1 | 11/2001 | Fincher et al. |
| 2002/0077971 | A1 | 1/2002 | Beufort et al. |
| 2002/0029908 | A1 | 3/2002 | Bloom et al. |
| 2005/0145415 | A1 | 7/2005 | Doering et al. |
| 2007/0095532 | A1 | 5/2007 | Head et al. |
| 2007/0261887 | A1 | 11/2007 | Pai et al. |
| 2008/0061647 | A1 | 3/2008 | Schmitt |
| 2008/0066963 | A1 | 3/2008 | Sheiretov et al. |
| 2008/0073077 | A1 | 3/2008 | Tunc et al. |
| 2008/0110635 | A1 | 5/2008 | Loretz et al. |
| 2008/0196901 | A1 | 8/2008 | Aguirre et al. |
| 2008/0202769 | A1 | 8/2008 | Dupree et al. |
| 2008/0308318 | A1* | 12/2008 | Moore ..... 175/51 |
| 2008/0314639 | A1 | 12/2008 | Kotsonis et al. |
| 2009/0008150 | A1 | 1/2009 | Lavrut et al. |
| 2009/0071660 | A1 | 3/2009 | Martinez et al. |
| 2009/0091278 | A1 | 4/2009 | Montois et al. |
| 2009/0159295 | A1 | 6/2009 | Guerrero et al. |
| 2009/0218105 | A1 | 9/2009 | Hill et al. |
| 2009/0229820 | A1 | 9/2009 | Saeed |
| 2009/0236101 | A1 | 9/2009 | Nelson et al. |
| 2009/0294124 | A1 | 12/2009 | Patel |
| 2009/0321141 | A1 | 12/2009 | Kotsonis et al. |
| 2010/0018695 | A1 | 1/2010 | Bloom et al. |
| 2010/0038138 | A1 | 2/2010 | Mock et al. |
| 2010/0108387 | A1 | 5/2010 | Bloom et al. |
| 2010/0108394 | A1 | 5/2010 | Ollerenshaw et al. |
| 2011/0127046 | A1 | 6/2011 | Aguirre et al. |
| 2012/0061074 | A1 | 3/2012 | Bloom et al. |
| 2012/0061075 | A1 | 3/2012 | Mock |
| 2013/0113227 | A1 | 5/2013 | Mitchel |

FOREIGN PATENT DOCUMENTS

| | | |
|---|---|---|
| CA | 2 250 483 | 4/1999 |
| CA | 2 336 421 | 1/2006 |
| CA | 2 436 944 | 5/2012 |
| CA | 2 515 482 | 5/2013 |
| DE | 24 39 063 | 2/1976 |
| DE | 29 20 049 | 2/1981 |
| EP | 0 149 528 | 7/1985 |
| EP | 0 951 611 | 1/1993 |
| EP | 0 257 744 | 1/1995 |
| EP | 0 767 289 | 4/1997 |
| EP | 0 911 483 | 4/1997 |
| EP | 1 281 834 | 2/2003 |
| EP | 1 344 893 | 9/2003 |
| EP | 1 370 891 | 11/2006 |
| EP | 1 223 305 | 4/2008 |
| GB | 894 117 | 4/1962 |
| GB | 1 105 701 | 3/1968 |
| GB | 2 048 339 | 12/1980 |
| GB | 2 241 723 | 9/1991 |
| GB | 2 305 407 | 4/1997 |
| GB | 2 310 871 | 9/1997 |
| GB | 2 346 908 | 8/2000 |
| GB | 2 362 405 | 11/2004 |
| GB | 2 401 130 | 11/2004 |
| GB | 2 389 135 | 11/2005 |
| GB | 2 413 816 | 1/2006 |
| GB | 2 414 499 | 6/2006 |
| WO | WO 89/05391 | 6/1989 |
| WO | WO 92/13226 | 8/1992 |
| WO | WO 93/18277 | 9/1993 |
| WO | WO 94/27022 | 11/1994 |
| WO | WO 95/21987 | 8/1995 |
| WO | WO 98/01651 | 1/1998 |
| WO | WO 00/36266 | 6/2000 |
| WO | WO 00/46461 | 8/2000 |
| WO | WO 00/63606 | 10/2000 |
| WO | WO 00/73619 | 12/2000 |
| WO | WO 02/44509 | 6/2002 |
| WO | WO 2004/072433 | 8/2004 |
| WO | WO 2005/057076 | 6/2005 |
| WO | WO 2007039025 | 4/2007 |
| WO | WO 2007134748 | 11/2007 |
| WO | WO 2008/104177 | 9/2008 |
| WO | WO 2008/104178 | 9/2008 |
| WO | WO 2008/104179 | 9/2008 |
| WO | WO 2008/128542 | 10/2008 |
| WO | WO 2008/128543 | 10/2008 |
| WO | WO 2009/062718 | 5/2009 |
| WO | WO 2010/062186 | 6/2010 |
| WO | WO 2011/005519 | 1/2011 |
| WO | WO 2013/063317 | 5/2013 |

* cited by examiner

GRIPPER ASSEMBLY FOR DOWNHOLE TOOLS

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

RELATED APPLICATIONS

This application is a continuation of U.S. patent application Ser. No. 13/300,452, filed Nov. 18, 2011, which is a continuation of U.S. patent application Ser. No. 12/572,916, filed Oct. 2, 2009, now U.S. Pat. No. 8,069,917, which is a continuation of U.S. patent application Ser. No. 11/865,676, filed Oct. 1, 2007, now U.S. Pat. No. 7,604,060, which is a continuation of U.S. patent application Ser. No. 11/418,449, filed May 3, 2006, now U.S. Pat. No. 7,275,593, which is a continuation of U.S. patent application Ser. No. 10/690,054, filed Oct. 21, 2003, now U.S. Pat. No. 7,048,047, which is a continuation of U.S. patent application Ser. No. 10/268,604, filed Oct. 9, 2002, now U.S. Pat. No. 6,640,894, which is a continuation of U.S. patent application Ser. No. 09/777,421, filed Feb. 6, 2001, now U.S. Pat. No. 6,464,003, which claims the benefit under 35 U.S.C. §119 of U.S. Provisional Patent Application Ser. No. 60/205,937, entitled "PACKERFOOT IMPROVEMENTS," filed on May 18, 2000; and U.S. Provisional Patent Application Ser. No. 60/228,918, entitled "ROLLER TOE GRIPPER," filed on Aug. 29, 2000. Each of the above-identified applications is hereby incorporated by reference in its entirety.

FIELD OF THE INVENTION

The present invention relates generally to grippers for downhole tractors and, specifically, to improved gripper assemblies.

DESCRIPTION OF THE RELATED ART AND SUMMARY OF THE INVENTION

Tractors for moving within underground boreholes are used for a variety of purposes, such as oil drilling, mining, laying communication lines, and many other purposes. In the petroleum industry, for example, a typical oil well comprises a vertical borehole that is drilled by a rotary drill bit attached to the end of a drill string. The drill string may be constructed of a series of connected links of drill pipe that extend between ground surface equipment and the aft end of the tractor. Alternatively, the drill string may comprise flexible tubing or "coiled tubing" connected to the aft end of the tractor. A drilling fluid, such as drilling mud, is pumped from the ground surface equipment through an interior flow channel of the drill string and through the tractor to the drill bit. The drilling fluid is used to cool and lubricate the bit, and to remove debris and rock chips from the borehole, which are created by the drilling process. The drilling fluid returns to the surface, carrying the cuttings and debris, through the annular space between the outer surface of the drill pipe and the inner surface of the borehole.

Tractors for moving within downhole passages are often required to operate in harsh environments and limited space. For example, tractors used for oil drilling may encounter hydrostatic pressures as high as 16,000 psi and temperatures as high as 300° F. Typical boreholes for oil drilling are 3.5-27.5 inches in diameter. Further, to permit turning, the tractor length should be limited. Also, tractors must often have the capability to generate and exert substantial force against a formation. For example, operations such as drilling require thrust forces as high as 30,000 pounds.

As a result of the harsh working environment, space constraints, and desired force generation requirements, downhole tractors are used only in very limited situations, such as within existing well bore casing. While a number of the inventors of this application have previously developed a significantly improved design for a downhole tractor, further improvements are desirable to achieve performance levels that would permit downhole tractors to achieve commercial success in other environments, such as open bore drilling.

In one known design, a tractor comprises an elongated body, a propulsion system for applying thrust to the body, and grippers for anchoring the tractor to the inner surface of a borehole or passage while such thrust is applied to the body. Each gripper has an actuated position in which the gripper substantially prevents relative movement between the gripper and the inner surface of the passage, and a retracted position in which the gripper permits substantially free relative movement between the gripper and the inner surface of the passage. Typically, each gripper is slidingly engaged with the tractor body so that the body can be thrust longitudinally while the gripper is actuated. The grippers preferably do not substantially impede "flow-by," the flow of fluid returning from the drill bit up to the ground surface through the annulus between the tractor and the borehole surface.

Tractors may have at least two grippers that alternately actuate and reset to assist the motion of the tractor. In one cycle of operation, the body is thrust longitudinally along a first stroke length while a first gripper is actuated and a second gripper is retracted. During the first stroke length, the second gripper moves along the tractor body in a reset motion. Then, the second gripper is actuated and the first gripper is subsequently retracted. The body is thrust longitudinally along a second stroke length. During the second stroke length, the first gripper moves along the tractor body in a reset motion. The first gripper is then actuated and the second gripper subsequently retracted. The cycle then repeats. Alternatively, a tractor may be equipped with only a single gripper for specialized applications of well intervention, such as movement of sliding sleeves or perforation equipment.

Grippers are often designed to be powered by fluid, such as drilling mud in an open tractor system or hydraulic fluid in a closed tractor system. Typically, a gripper assembly has an actuation fluid chamber that receives pressurized fluid to cause the gripper to move to its actuated position. The gripper assembly may also have a retraction fluid chamber that receives pressurized fluid to cause the gripper to move to its retracted position. Alternatively, the gripper assembly may have a mechanical retraction element, such as a coil spring or leaf spring, which biases the gripper back to its retracted position when the pressurized fluid is discharged. Motor-operated or hydraulically controlled valves in the tractor body can control the delivery of fluid to the various chambers of the gripper assembly.

The prior art includes a variety of different types of grippers for tractors. One type of gripper comprises a plurality of frictional elements, such as metallic friction pads, blocks, or plates, which are disposed about the circumference of the tractor body. The frictional elements are forced radially outward against the inner surface of a borehole under the force of fluid pressure. However, these gripper designs are either too large to fit within the small dimensions of a borehole or have limited radial expansion capabilities. Also, the size of these grippers often cause a large pressure drop in the flow-by fluid, i.e., the fluid returning from the drill bit up through the annulus between the tractor and the borehole. The pressure drop makes it harder to force the returning fluid up to the surface. Also, the pressure drop may cause drill cuttings to drop out of the main fluid path and clog up the annulus.

Another type of gripper comprises a bladder that is inflated by fluid to bear against the borehole surface. While inflatable bladders provide good conformance to the possibly irregular dimensions of a borehole, they do not provide very good torsional resistance. In other words, bladders tend to permit a certain degree of undesirable twisting or rotation of the tractor body, which may confuse the tractor's position sensors. Also, some bladder configurations may substantially impede the flow-by of fluid and drill cuttings returning up through the annulus to the surface.

Yet another type of gripper comprises a combination of bladders and flexible beams oriented generally parallel to the tractor body on the radial exterior of the bladders. The ends of the beams are maintained at a constant radial position near the surface of the tractor body, and may be permitted to slide longitudinally. Inflation of the bladders causes the beams to flex outwardly and contact the borehole wall. This design effectively separates the loads associated with radial expansion and torque. The bladders provide the loads for radial expansion and gripping onto the borehole wall, and the beams resist twisting or rotation of the tractor body. While this design represents a significant advancement over previous designs, the bladders provide limited radial expansion loads. As a result, the design is less effective in certain environments. Also, this design impedes to some extent the flow of fluid and drill cuttings upward through the annulus.

Yet another type of gripper comprises a pair of three-bar linkages separated by 180° about the circumference of the tractor body. FIG. 21 shows such a design. Each linkage 200 comprises a first link 202, a second link 204, and a third link 206. The first link 202 has a first end 208 pivotally or hingedly secured at or near the surface of the tractor body 201, and a second end 210 pivotally secured to a first end 212 of the second link 204. The second link 204 has a second end 214 pivotally secured to a first end 216 of the third link 206. The third link 206 has a second end 218 pivotally secured at or near the surface of the tractor body 201. The first end 208 of the first link 202 and the second end 218 of the third link 206 are maintained at a constant radial position and are longitudinally slidable with respect to one another. The second link 204 is designed to bear against the inner surface of a borehole wall. Radial displacement of the second link 204 is caused by the application of longitudinally directed fluid pressure forces onto the first end 208 of the first link 202 and/or the second end 218 of the third link 206, to force such ends toward one another. As the ends 208 and 218 move toward one another, the second link 204 moves radially outward to bear against the borehole surface and anchor the tractor.

One major disadvantage of the three-bar linkage gripper design is that it is difficult to generate significant radial expansion loads against the inner surface of the borehole until the second link 204 has been radially displaced a substantial degree. As noted above, the radial load applied to the borehole is generated by applying longitudinally directed fluid pressure forces onto the first and third links. These fluid pressure forces cause the first end 208 of the first link 202 and the second end 218 of the third link 206 to move together until the second link 204 makes contact with the borehole. Then, the fluid pressure forces are transmitted through the first and third links to the second link and onto the borehole wall. However, the radial component of the transmitted forces is proportional to the sine of the angle θ between the first or third link and the tractor body 201. In the retracted position of the gripper, all three of the links are oriented generally parallel to the tractor body 201, so that θ is zero or very small. Thus, when the gripper is in or is near the retracted position, the gripper is incapable of transmitting any significant radial load to the borehole wall. In small diameter boreholes, in which the second link 204 is displaced only slightly before coming into contact with the borehole surface, the gripper provides a very limited radial load. Thus, in small diameter environments, the gripper cannot reliably anchor the tractor. As a result, this three-bar linkage gripper is not useful in small diameter boreholes or in small diameter sections of generally larger boreholes. If the three-bar linkage was modified so that the angle θ is always large, the linkage would then be able to accommodate only very small variations in the diameter of the borehole.

Another disadvantage of the three-bar linkage gripper design is that it is not sufficiently resistant to torque in the tractor body. The links are connected by hinges or axles that permit a certain degree of twisting of the tractor body when the gripper is actuated. During drilling, the borehole formation exerts a reaction torque onto the tractor body, opposite to the direction of drill bit rotation. This torque is transmitted through the tractor body to an actuated gripper. However, since the gripper does not have sufficient torsional rigidity, it does not transmit all of the torque to the borehole. The three-bar linkage permits a certain degree of rotation. This leads to excessive twisting and untwisting of the tractor body, which can confuse the tractor's position sensors and/or require repeated recalibration of the sensors. Yet another disadvantage of the multi-bar linkage gripper design is that it involves stress concentrations at the hinges or joints between the links. Such stress concentrations introduce a high probability of premature failure.

Some types of grippers have gripping elements that are actuated or retracted by causing different surfaces of the gripper assembly to slide against each other. Moving the gripper between its actuated and retracted positions involves substantial sliding friction between these sliding surfaces. The sliding friction is proportional to the normal forces between the sliding surfaces. A major disadvantage of these grippers is that the sliding friction can significantly impede their operation, especially if the normal forces between the sliding surfaces are large. The sliding friction may limit the extent of radial displacement of the gripping elements as well as the amount of radial gripping force that is applied to the inner surface of a borehole. Thus, it may be difficult to transmit larger loads to the passage, as may be required for certain operations, such as drilling. Another disadvantage of these grippers is that drilling fluid, drill cuttings, and other particles can get caught between and damage the sliding surfaces as they slide against one another. Also, such intermediate particles can add to the sliding friction and further impede actuation and retraction of the gripper.

In at least one embodiment of the present invention, there is provided an improved gripper assembly that overcomes the above-mentioned problems of the prior art.

In one aspect, there is provided a gripper assembly for anchoring a tool within a passage and for assisting movement of the tool within the passage. The gripper assembly is movable along an elongated shaft of the tool. The gripper assembly has an actuated position in which the gripper assembly substantially prevents movement between the gripper assembly and an inner surface of the passage, and a retracted position in which the gripper assembly permits substantially free relative movement between the gripper assembly and the inner surface of the passage. The gripper assembly comprises an elongated mandrel, a first toe support longitudinally fixed with respect to the mandrel, a second toe support longitudinally slidable with respect to the mandrel, a flexible elongated toe, a driver, and a driver interaction element. The mandrel surrounds and is configured to be longitudinally slidable with respect to the shaft of the tractor. The toe has a first end pivotally secured with respect to the first toe support and a second end pivotally secured with respect to the second toe support so that the first and second ends of the toe have an at least substantially constant radial position with respect to a longitudinal axis of the mandrel. The toe comprises a single beam.

The driver is longitudinally slidable with respect to the mandrel, and is slidable between a retraction position and an actuation position. The driver interaction element is positioned on a central region of the toe and is configured to interact with the driver. Longitudinal movement of the driver causes interaction between the driver and the driver interaction element substantially without sliding friction therebetween. The interaction between the driver and the driver interaction element varies the radial position of the central region of the toe. When the driver is in the retraction position, the central region of the toe is at a first radial distance from the longitudinal axis of the mandrel and the gripper assembly is in the retracted position. When the driver is in the actuation position, the central region of the toe is at a second radial distance from the longitudinal axis and the gripper assembly is in the actuated position. The second radial distance is greater than the first radial distance.

In another aspect, the present invention provides a gripper assembly for use with a tractor for moving within a passage. The gripper assembly is longitudinally slidable along an elongated shaft of the tractor. The gripper assembly has actuated and retracted positions as described above. The gripper assembly comprises an elongated mandrel, a first toe support longitudinally fixed with respect to the mandrel, a second toe support longitudinally slidable with respect to the mandrel, a flexible elongated toe, a ramp, and a roller. The mandrel is configured to be longitudinally slidable with respect to the shaft of the tractor. The toe has a first end pivotally secured with respect to the first toe support and a second end pivotally secured with respect to the second toe support. The ramp has an inclined surface that extends between an inner radial level and an outer radial level, the inner radial level being radially closer to the surface of the mandrel than the outer radial level. The ramp is longitudinally slidable with respect to the mandrel. The roller is rotatably secured to a center region of the toe and is configured to roll against the ramp. In a preferred embodiment, the toe preferably comprises a single beam.

Longitudinal movement of the ramp causes the roller to roll against the ramp between the inner and outer levels to vary the radial position of the center region of the toe between a radially inner position corresponding to the retracted position of the gripper assembly and a radially outer position corresponding to the actuated position of the gripper assembly. Preferably, the ramp is movable between first and second longitudinal positions relative to the mandrel. When the ramp is in the first position, the roller is at the inner radial level and the gripper assembly is in the retracted position. When the ramp is in the second position, the roller is at the outer radial level and the gripper assembly is in the actuated position.

In yet another aspect, the present invention provides a gripper assembly for use with a tractor for moving within a passage, the tractor having an elongated shaft. The gripper assembly has actuated and retracted positions as described above. The gripper assembly comprises an elongated mandrel, a first toe support longitudinally fixed with respect to the mandrel, a second beam support longitudinally slidable with respect to the mandrel, a flexible toe, a piston longitudinally slidable with respect to the mandrel, a ramp, a slider element, and a roller. The mandrel is configured to be longitudinally slidable with respect to the shaft of the tractor. The toe has a first end pivotally secured with respect to the first toe support and a second end pivotally secured with respect to the second toe support. The ramp is positioned on an inner surface of the toe. The ramp slopes from a first end to a second end, the second end being radially closer to the surface of the mandrel than the first end. The slider element is longitudinally slidable with respect to the mandrel and longitudinally fixed with respect to the piston. The roller is rotatably fixed with respect to the slider element and configured to roll against the ramp.

The ramp is oriented such that longitudinal movement of the slider element causes the roller to roll against the ramp to vary the radial position of the center region of the toe between a radially inner position corresponding to the retracted position of the gripper assembly and a radially outer position corresponding to the actuated position of the gripper assembly. The piston and the slider element are movable between first and second longitudinal positions relative to the mandrel. When the piston and the slider element are in the first position, the first end of the ramp bears against the roller and the gripper assembly is in the retracted position. When the piston and the slider element are in the second position, the second end of the ramp bears against the roller and the gripper assembly is in the actuated position.

In yet another aspect, the present invention provides a gripper assembly for use with a tractor for moving within a passage, the tractor having an elongated shaft. The gripper assembly has actuated and retracted positions as described above. The gripper assembly comprises an elongated mandrel, a first toe support longitudinally fixed with respect to the mandrel, a second toe support longitudinally slidable with respect to the mandrel, a flexible elongated toe, a slider element, and one or more elongated toggles. The mandrel is configured to be longitudinally slidable with respect to the shaft of the tractor. The toe has a first end pivotally secured with respect to the first toe support and a second end pivotally secured with respect to the second toe support. The slider element is longitudinally slidable with respect to the mandrel, and is slidable between first and second positions. The toggles have first ends rotatably maintained on the slider element and second ends rotatably maintained on a center region of the toe. The toe preferably comprises a single beam.

The toggles are adapted to rotate between a retracted position in which the second ends of the toggles and the center region of the toe are at a radially inner level that defines the retracted position of the gripper assembly, and an actuated position in which the second ends of the toggles and the center region of the toe are at a radially outer level that defines the actuated position of the gripper assembly. Longitudinal movement of the slider element causes longitudinal movement of the first ends of the toggles, to thereby rotate the toggles. When the slider element is in the first position the toggles are in the retracted position. When the slider element is in the second position the toggles are in the actuated position.

For purposes of summarizing the invention and the advantages achieved over the prior art, certain objects and advantages of the invention have been described above and as further described below. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

DETAILED DESCRIPTION OF THE PREFERRED EMBODIMENT

Coiled Tubing Tractor Systems

Figure 1:
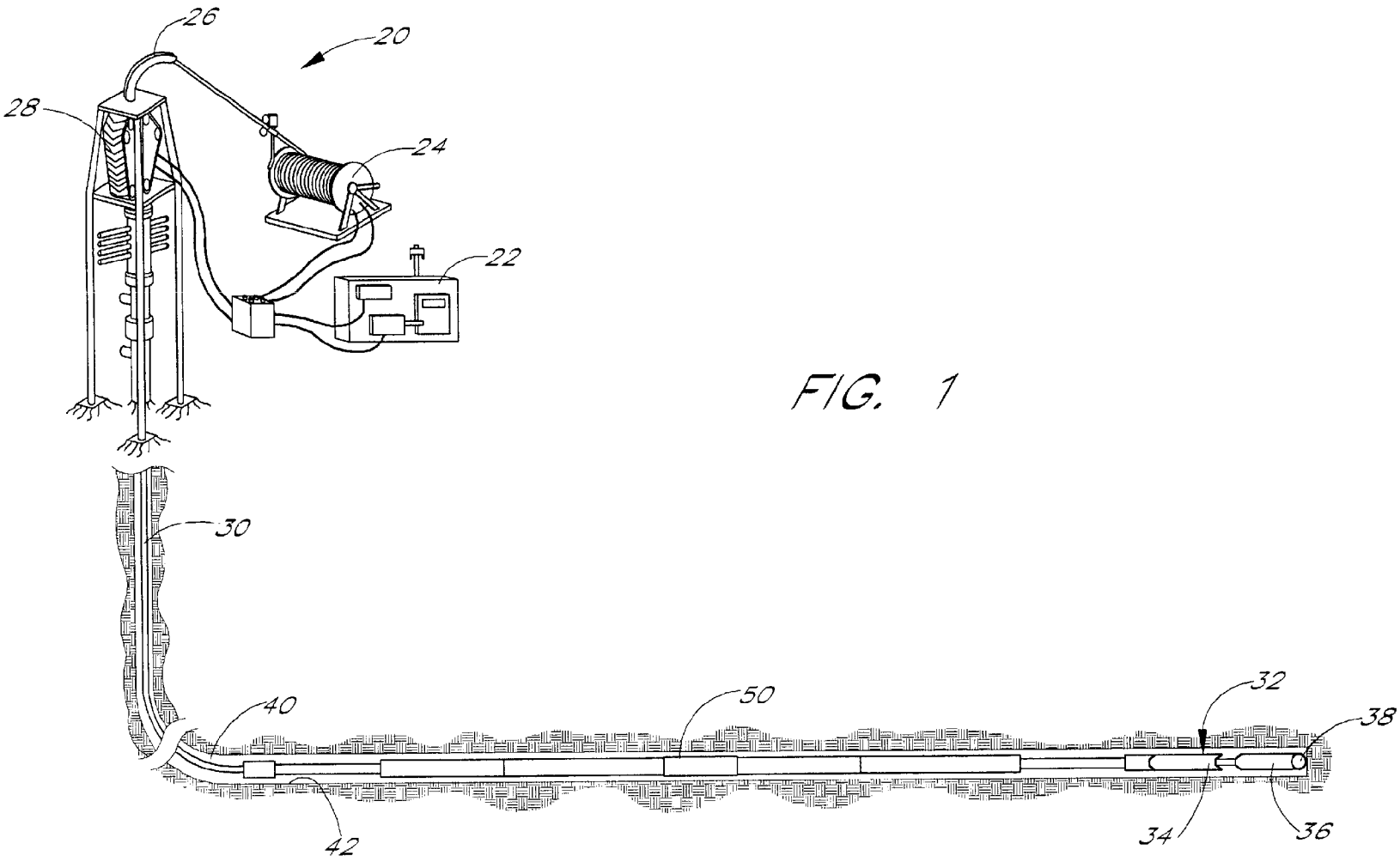
FIG. 1 is a schematic diagram of the major components of a coiled tubing drilling system having gripper assemblies according to a preferred embodiment of the present invention.

FIG. 1 shows a coiled tubing system 20 for use with a downhole tractor 50 for moving within a passage. The tractor 50 has two gripper assemblies 100 (FIG. 2) according to the present invention. Those of skill in the art will understand that any number of gripper assemblies 100 may be used. The coiled tubing drilling system 20 may include a power supply 22, tubing reel 24, tubing guide 26, tubing injector 28, and coiled tubing 30, all of which are well known in the art. A bottom hole assembly 32 may be assembled with the tractor 50. The bottom hole assembly may include a measurement while drilling (MWD) system 34, downhole motor 36, drill bit 38, and various sensors, all of which are also known in the art. The tractor 50 is configured to move within a borehole having an inner surface 42. An annulus 40 is defined by the space between the tractor 50 and the inner surface 42.

Various embodiments of the gripper assemblies 100 are described herein. It should be noted that the gripper assemblies 100 may be used with a variety of different tractor designs, including, for example, (1) the "PULLER-THRUSTER DOWNHOLE TOOL," shown and described in U.S. Pat. No. 6,003,606 to Moore et al.; (2) the "ELECTRICALLY SEQUENCED TRACTOR," shown and described in U.S. Pat. No. 6,347,674; and (3) the "ELECTRO-HYDRAULICALLY CONTROLLED TRACTOR," shown and described in U.S. Pat. No. 6,241,031, all of which are hereby incorporated herein by reference, in their entirety.

Figure 2:
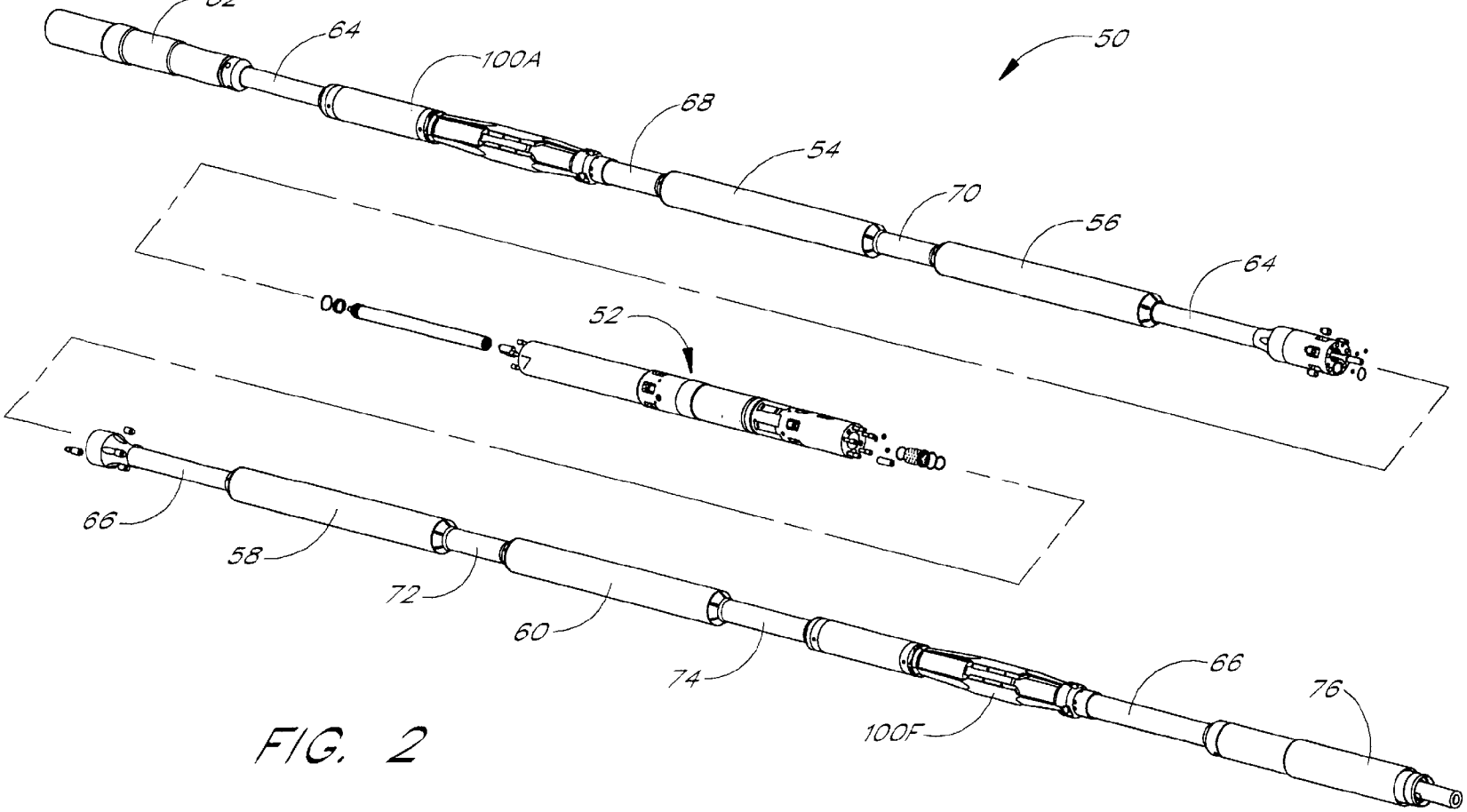
FIG. 2 is a front perspective view of a tractor having gripper assemblies according to a preferred embodiment of the present invention.

FIG. 2 shows a preferred embodiment of a tractor 50 having gripper assemblies 100A and 100F according to the present invention. The illustrated tractor 50 is an Electrically Sequenced Tractor (EST), as identified above. The tractor 50 includes a central control assembly 52, an uphole or aft gripper assembly 100A, a downhole or forward gripper assembly 100F, aft propulsion cylinders 54 and 56, forward propulsion cylinders 58 and 60, a drill string connector 62, shafts 64 and 66, flexible connectors 68, 70, 72, and 74, and a bottom hole assembly connector 76. The drill string connector 62 connects a drill string, such as the coiled tubing 30 (FIG. 1), to the shaft 64. The aft gripper assembly 100A, aft propulsion cylinders 54 and 56, and connectors 68 and 70 are assembled together end to end and are all axially slidably engaged with the shaft 64. Similarly, the forward packerfoot 100F, forward propulsion cylinders 58 and 60, and connectors 72 and 74 are assembled together end to end and are slidably engaged with the shaft 66. The connector 129 provides a connection between the tractor 50 and downhole equipment such as a bottom hole assembly. The shafts 64 and 66 and the control assembly 52 are axially fixed with respect to one another and are sometimes referred to herein as the body of the tractor 50. The body of the tractor 52 is thus axially fixed with respect to the drill string and the bottom hole assembly.

As used herein, "aft" refers to the uphole direction or portion of an element in a passage, and "forward" refers to the downhole direction or portion of an element. When an element is removed from a downhole passage, the aft end of the element emerges from the hole before the forward end.

Gripper Assembly with Rollers on Toes

Figure 3:
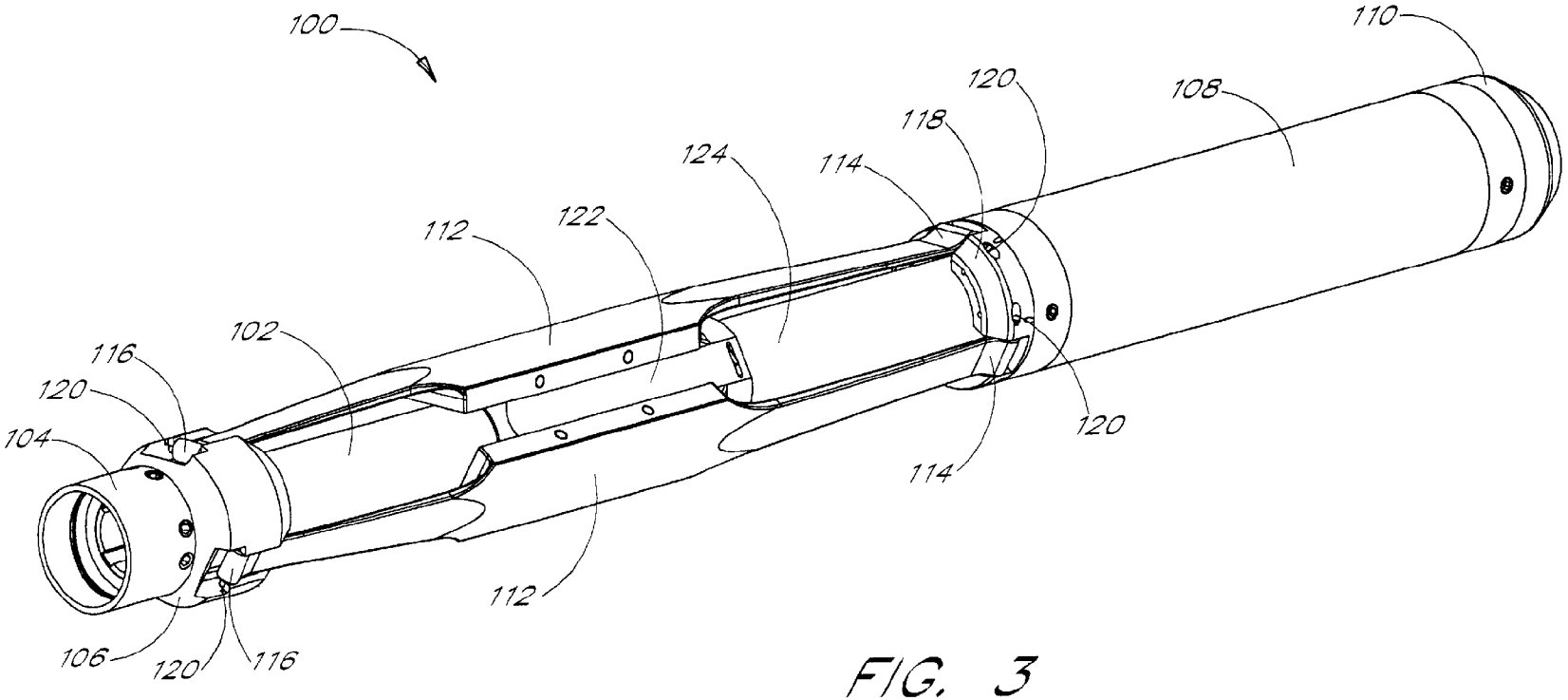
FIG. 3 is a perspective view of a gripper assembly having rollers secured to its toes, shown in a retracted or non-gripping position.
Figure 4:
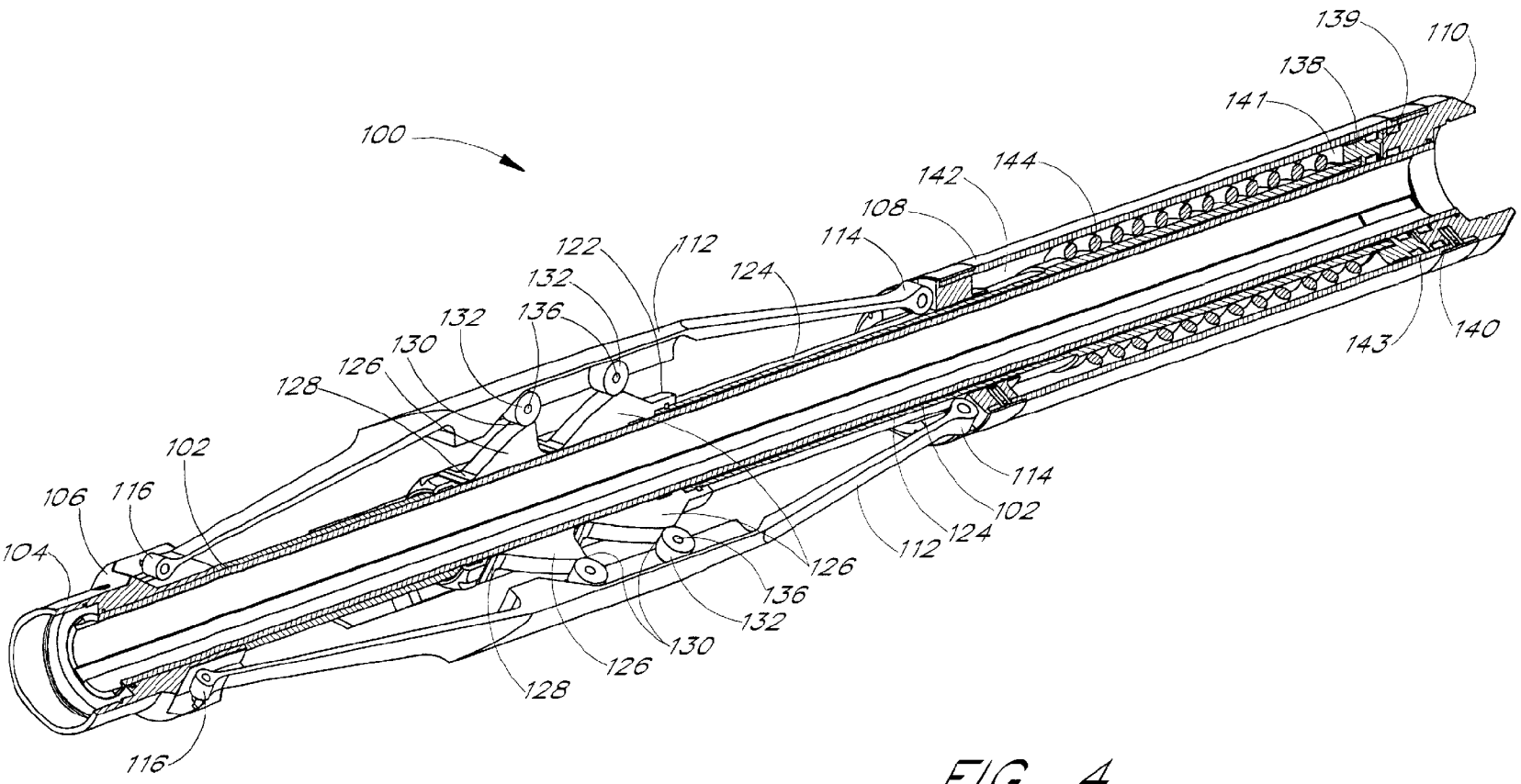
FIG. 4 is a longitudinal cross-sectional view of a gripper assembly having rollers secured to its toes, shown in an actuated or gripping position.

FIG. 3 shows a gripper assembly 100 according to one embodiment of the present invention. The illustrated gripper assembly includes an elongated generally tubular mandrel 102 configured to slide longitudinally along a length of the tractor 50, such as on one of the shafts 64 and 66 (FIG. 2). Preferably, the interior surface of the mandrel 102 has a splined interface (e.g., tongue and groove configuration) with the exterior surface of the shaft, so that the mandrel 102 is free to slide longitudinally yet is prevented from rotating with respect to the shaft. In another embodiment, splines are not included. Fixed mandrel caps 104 and 110 are connected to the forward and aft ends of the mandrel 102, respectively. On the forward end of the mandrel 102, near the mandrel cap 104, a sliding toe support 106 is longitudinally slidably engaged on the mandrel 102. Preferably, the sliding toe support 106 is prevented from rotating with respect to the mandrel 102, such as by a splined interaction therebetween. On the aft end of the mandrel 102, a cylinder 108 is positioned next to the mandrel cap 110 and concentrically encloses the mandrel so as to form an annular space therebetween. As shown in FIG. 4, this annular space contains a piston 138, an aft portion of a piston rod 124, a spring 144, and fluid seals, for reasons that will become apparent.

The cylinder 108 is fixed with respect to the mandrel 102. A toe support 118 is fixed onto the forward end of the cylinder 108. A plurality of gripper portions 112 are secured onto the gripper assembly 100. In the illustrated embodiment the gripper portions comprise flexible toes or beams 112. The toes 112 have ends 114 pivotally or hingedly secured to the fixed toe support 118 and ends 116 pivotally or hingedly secured to the sliding toe support 106. As used herein, "pivotally" or "hingedly" describes a connection that permits rotation, such as by a pin or hinge. The ends of the toes 112 are engaged on rods or pins secured to the toe supports.

Those of skill in the art will understand that any number of toes 112 may be provided. As more toes are provided, the maximum radial load that can be transmitted to the borehole surface is increased. This improves the gripping power of the gripper assembly 100, and therefore permits greater radial thrust and drilling power of the tractor. However, it is preferred to have three toes 112 for more reliable gripping of the gripper assembly 100 onto the inner surface of a borehole, such as the surface 42 in FIG. 1. For example, a four-toed embodiment could result in only two toes making contact with the borehole surface in oval-shaped holes. Additionally, as the number of toes increases, so does the potential for synchronization and alignment problems of the toes. In addition, at least three toes 112 are preferred, to substantially prevent the potential for rotation of the tractor about a transverse axis, i.e., one that is generally perpendicular to the longitudinal axis of the tractor body. For example, the three-bar linkage gripper described above has only two linkages. Even when both linkages are actuated, the tractor body can rotate about the axis defined by the two contact points of the linkages with the borehole surface. A three-toe embodiment of the present invention substantially prevents such rotation. Further, gripper assemblies having at least three toes 112 are more capable of traversing underground voids in a borehole.

A driver or slider element 122 is slidably engaged on the mandrel 102 and is longitudinally positioned generally at about a longitudinal central region of the toes 112. The slider element 122 is positioned radially inward of the toes 112, for reasons that will become apparent. A tubular piston rod 124 is slidably engaged on the mandrel 102 and connected to the aft end of the slider element 122. The piston rod 124 is partially enclosed by the cylinder 108. The slider element 122 and the piston rod 124 are preferably prevented from rotating with respect to the mandrel 102, such as by a splined interface between such elements and the mandrel.

Figure 5:
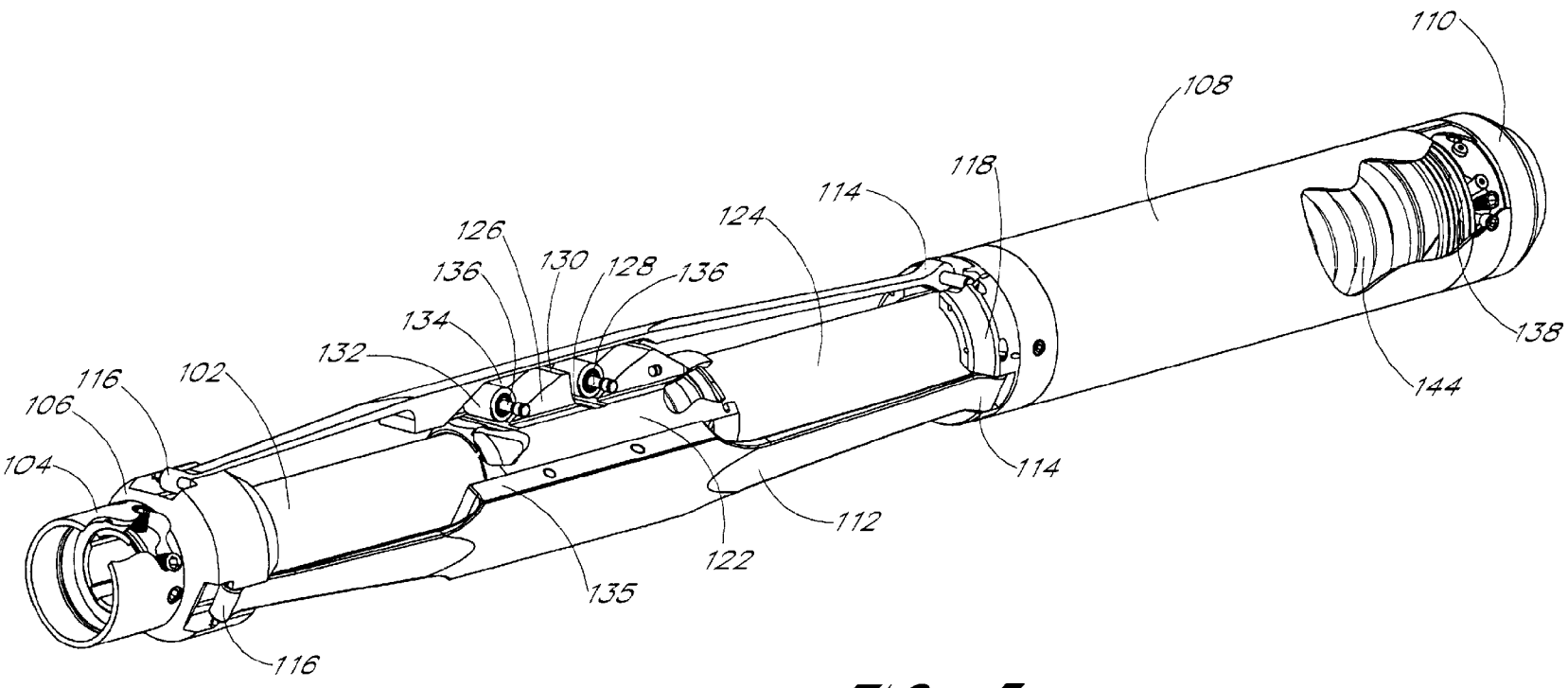
FIG. 5 is a perspective partial cut-away view of the gripper assembly of FIG. 3.
Figure 6:
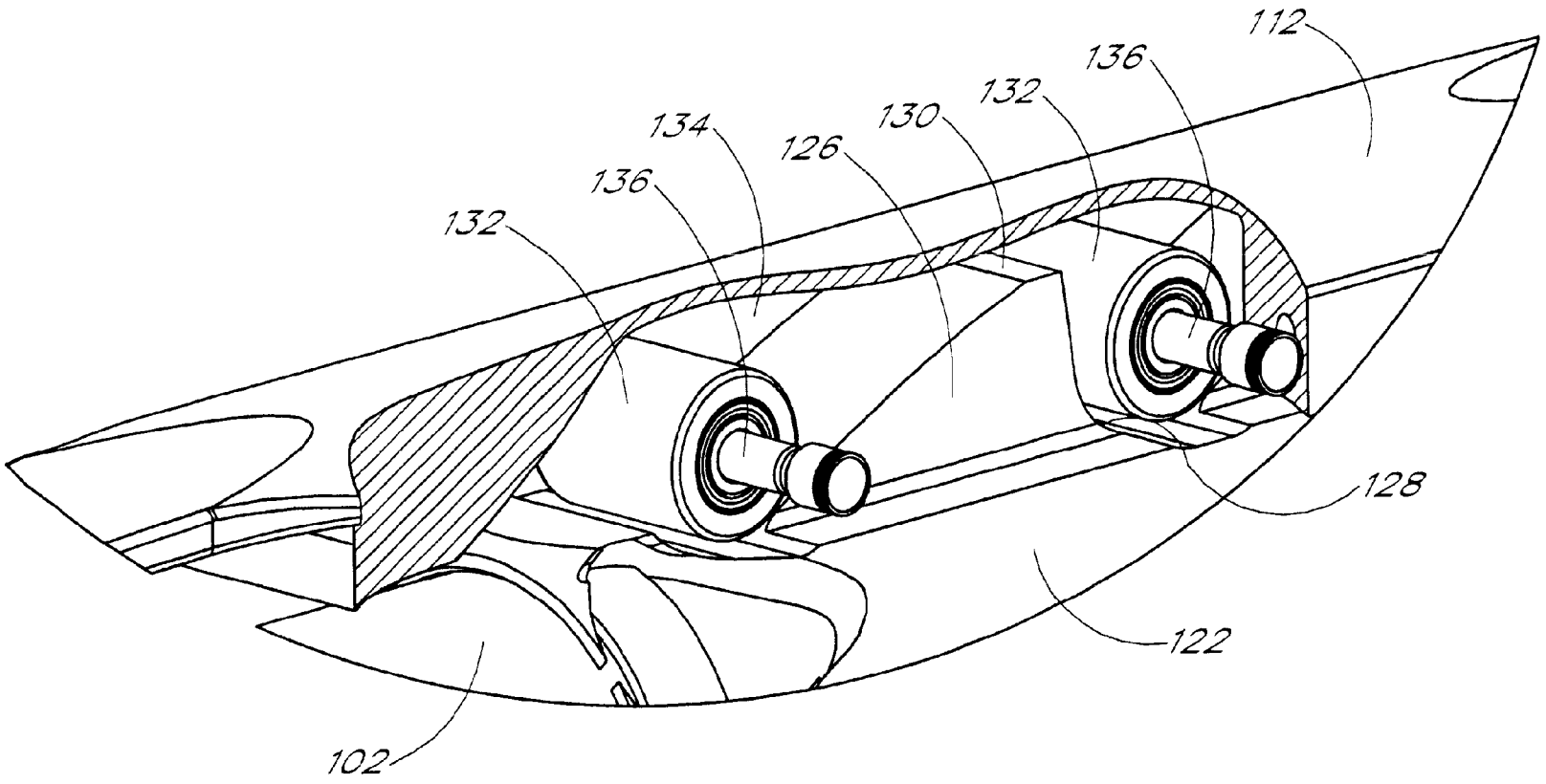
FIG. 6 is an exploded view of one set of rollers for a toe of the gripper assembly of FIG. 5.

FIG. 4 shows a longitudinal cross-section of a gripper assembly 100. FIGS. 5 and 6 show a gripper assembly 100 in a partial cut-away view. As seen in the figures, the slider element 122 includes a multiplicity of wedges or ramps 126. Each ramp 126 slopes between an inner radial level 128 and an outer radial level 130, the inner level 128 being radially closer to the surface of the mandrel 102 than the outer level 130. Desirably, the slider element 122 includes at least one ramp 126 for each toe 112. Of course, the slider element 122 may include any number of ramps 126 for each toe 112. In the illustrated embodiments, the slider element 122 includes two ramps 126 for each toe 112. As more ramps 126 are provided for each toe, the amount of force that each ramp must transmit is reduced, producing a longer fatigue life of the ramps. Also, the provision of additional ramps results in more uniform radial displacement of the toes 112, as well as radial displacement of a relatively longer length of the toes 112, both resulting in better overall gripping onto the borehole surface.

In a preferred embodiment, two ramps 126 are spaced apart generally by the length of the central region 148 (FIG. 7) of each toe 112. In this embodiment, when the gripper assembly is actuated to grip onto a borehole surface, the central regions 148 of the toes 112 have a greater tendency to remain generally linear. This results in a greater surface area of contact between the toes and the borehole surface, for better overall gripping. Also, a more uniform load is distributed to the toes to facilitate better gripping. With more than two ramps, there is a greater proclivity for uneven load distribution as a result of manufacturing variations in the radial dimensions of the ramps 126, which can result in premature fatigue failure.

Each toe 112 is provided with a driver interaction element on the central region 148 (FIG. 7) of the toe. The driver interaction element interacts with the driver or slider element 122 to vary the radial position of the central region 148 of the toe 112. Preferably, the driver and driver interaction element are configured to interact substantially without production of sliding friction therebetween. In the embodiment illustrated in FIGS. 3-8, the driver interaction element comprises one or more rollers 132 that are rotatably secured on the toes 112 and configured to roll upon the inclined surfaces of the ramps 126. Preferably, there is one roller 132 for every ramp 126 on the slider element 122. In the illustrated embodiments, the rollers 132 of each toe 112 are positioned within a recess 134 on the radially interior surface of the toe, the recess 134 extending longitudinally and being sized to receive the ramps 126. The rollers 132 rotate on axles 136 that extend transversely within the recess 134. The ends of the axles 136 are secured within holes in the sidewalls 135 (FIGS. 5, 7, and 8) that define the recess 134.

The piston rod 124 connects the slider element 122 to a piston 138 enclosed within the cylinder 108. The piston 138 has a generally tubular shape. The piston 138 has an aft or actuation side 139 and a forward or retraction side 141. The piston rod 124 and the piston 138 are longitudinally slidably engaged on the mandrel 102. The forward end of the piston rod 124 is attached to the slider element 122. The aft end of the piston rod 124 is attached to the retraction side 141 of the piston 138. The piston 138 fluidly divides the annular space between the mandrel 102 and the cylinder 108 into an aft or actuation chamber 140 and a forward or retraction chamber 142. A seal 143, such as a rubber O-ring, is preferably provided between the outer surface of the piston 138 and the inner surface of the cylinder 108. A return spring 144 is engaged on the piston rod 124 and enclosed within the cylinder 108. The spring 144 has an aft end attached to and/or biased against the retraction side 141 of the piston 138. A forward end of the spring 144 is attached to and/or biased against the interior surface of the forward end of the cylinder 108. The spring 144 biases the piston 138, piston rod 124, and slider element 122 toward the aft end of the mandrel 102. In the illustrated embodiment, the spring 144 comprises a coil spring. The number of coils and spring diameter is preferably chosen based on the required return loads and the space available. Those of ordinary skill in the art will understand that other types of springs or biasing means may be used.

Figure 7:
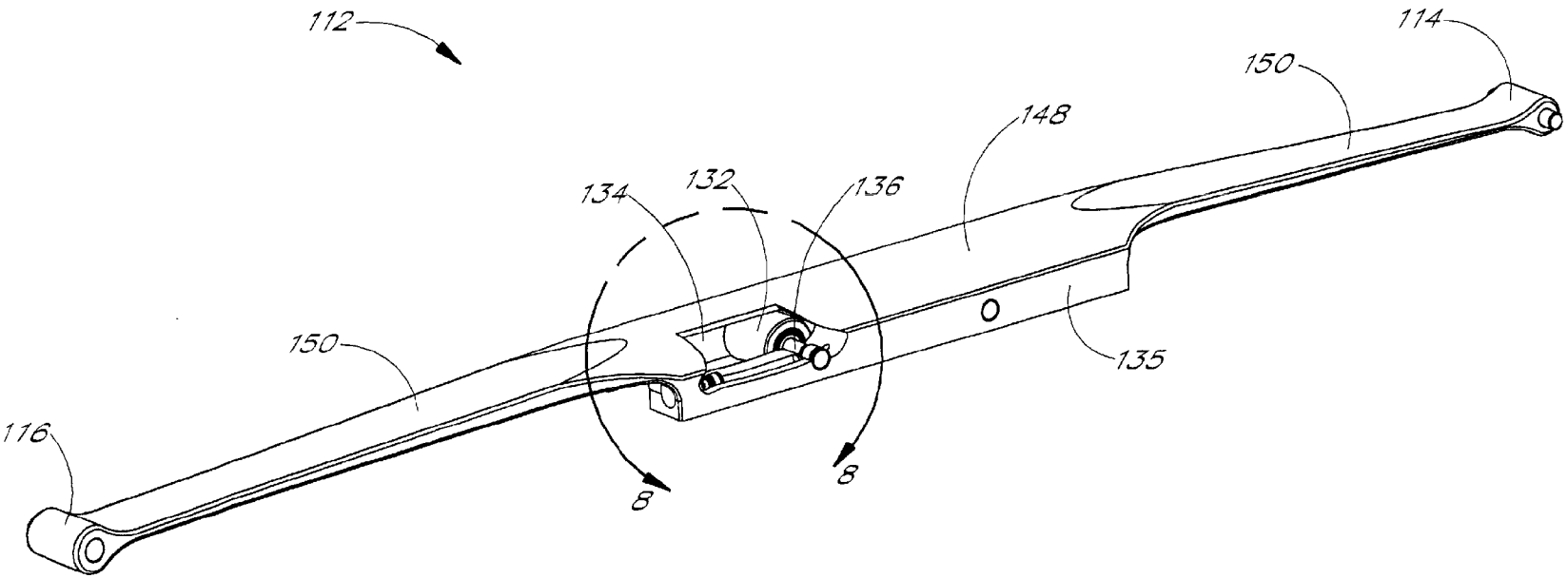
FIG. 7 is a perspective view of a toe of a gripper assembly having rollers secured to its toes.
Figure 8:
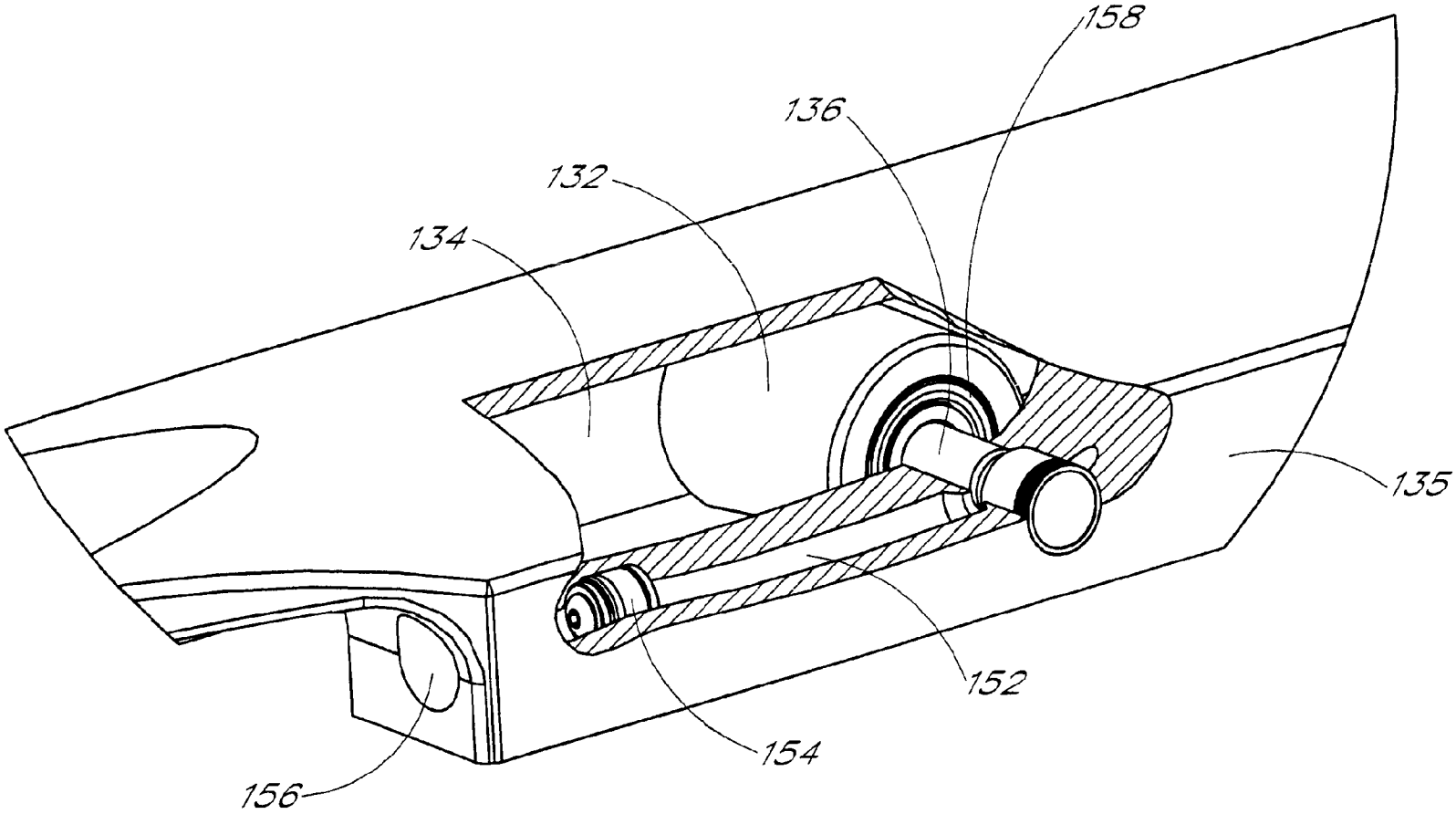
FIG. 8 is an exploded view of one of the rollers and the pressure compensation and lubrication system of the toe of FIG. 7.

FIGS. 7 and 8 show a toe 112 configured according to a preferred embodiment of the invention. The toe 112 preferably comprises a single beam configured so that bending stresses are transmitted throughout the length of the toe. In one embodiment, the toe 112 is configured so that the bending stresses are transmitted substantially uniformly throughout the toe, while in other embodiments bending stresses may be concentrated in certain locations. The toe 112 preferably includes a generally wider and thicker central section 148 and thinner and less wide sections 150. An enlarged section 148 provides more surface area of contact between the toe 112 and the inner surface of a passage. This results in better transmission of loads to the passage. The section 148 can have an increased thickness for reduced flexibility. This also results in a greater surface area of contact. The outer surface of the central section 148 is preferably roughened to permit more effective gripping against a surface, such as the inner surface of a borehole or passage. In various embodiments, the toes 112 have a bending strength within the range of 50,000-350,000 psi, within the range of 60,000-350,000 psi, or within the range of 60,000-150,000 psi. In various embodiments, the toes 112 have a tensile modulus within the range of 1,000,000-30,000,000, within the range of 1,000,000-15,000,000 psi, within the range of 8,000,000-30,000,000 psi, or within the range of 8,000,000-15,000,000 psi. In the illustrated embodiment, a copper-beryllium alloy with a tensile strength of 150,000 psi and a tensile modulus of 10,000,000 psi is preferred.

The central section 148 of the toe 112 houses the rollers 132 and a pressure compensated lubrication system for the rollers. In the preferred embodiment, the lubrication system comprises two elongated lubrication reservoirs 152 (one in each sidewall 135), each housing a pressure compensation piston 154. The reservoirs 152 preferably contain a lubricant, such as oil or hydraulic fluid, which surrounds the ends of the roller axles 136. In the illustrated embodiment, each side wall 135 includes one reservoir 152 that lubricates the ends of the two axles 136 for the two rollers 132 contained within the toe 112. It will be understood by those of skill in the art that each toe 112 may instead include a single contiguous lubrication reservoir having sections in each of the side walls 135. Preferably, seals 158, such as O-ring or Teflon lip seals, are provided between the ends of the rollers 132 and the interior of the side walls 135 to prevent "flow-by" drilling fluid in the recess 134 from contacting the axles 136. As noted above, the axles 136 can be maintained in recesses in the inner surfaces of the sidewalls 135. Alternatively, the axles 136 can be maintained in holes that extend through the sidewalls 135, wherein the holes are sealed on the outer surfaces of the sidewalls 135 by plugs.

The pressure compensation pistons 154 maintain the lubricant pressure at about the pressure of the fluid in the annulus 40 (FIG. 1). This is because the pistons 154 are exposed to the annulus 40 by openings 156 in the central section 148 of the toes 112. As the pressure in the annulus 40 varies, the pistons 154 slide longitudinally within the elongated reservoirs 152 to equalize the pressure in the reservoirs to the annulus pressure. Additional seals may be provided on the pistons 154 to seal the lubricant in the reservoirs 152 from annulus fluids in the openings 156 and the annulus 40. Preferably, the pressure compensated lubrication reservoirs 152 are specially sized for the expected downhole conditions—approximately 16,000 psi hydrostatic pressure and 2500 psid differential pressure, as measured from the bore of the tractor to the annulus around the tractor.

The pressure compensation system provides better lubrication to the axles 136 and promotes longer life of the seals 158. As seen in FIG. 8, "flow-by" drilling mud in the recess 134 of the toe 112 is prevented from contacting the axles 136 by the seals 158 between the rollers 132 and the side walls 135. The lubricant in the lubrication reservoir 152 surrounds the entire length of the axles 136 that extends beyond the ends of the rollers 132. In other words, the lubricant extends all the way to the seals 158. The pressure compensation piston 154 maintains the pressure in the reservoir 152 at about the pressure of the drilling fluid in the annulus 40. Thus, the seals 158 are exposed to equal pressure on both sides, which increases the life of the seals. This in turn increases the life of the roller assembly, as drilling fluid is prevented from contacting the axles 136. Thus, there are no lubrication-starved portions of the axles 136. Without pressure-compensation, the downhole hydrostatic pressure in the annulus 40 could possibly collapse the region surrounding the axles 136, which would dramatically reduce the operational life of the axles 136 and the gripper assembly 100.

The gripper assembly 100 has an actuated position (as shown in FIG. 4) in which it substantially prevents movement between itself and an inner surface of the passage or borehole. The gripper assembly 100 has a retracted position (as shown in FIG. 3) in which it permits substantially free relative movement between itself and the inner surface of the passage. In the retracted position of the gripper assembly 100, the toes 112 are relaxed. In the actuated position, the toes 112 are flexed radially outward so that the exterior surfaces of the central sections 148 (FIG. 7) come into contact with the inner surface 42 (FIG. 1) of a borehole or passage. In the actuated position, the rollers 132 are at the radial outer levels 130 of the ramps 126. In the retracted position, the rollers 132 are at the radial inner levels 128 of the ramps 126.

The positioning of the piston 138 controls the position of the gripper assembly 100 (i.e., actuated or retracted). Preferably, the position of the piston 138 is controlled by supplying pressurized drilling fluid to the actuation chamber 140. The drilling fluid exerts a pressure force onto the aft or actuation side 139 of the piston 138, which tends to move the piston toward the forward end of the mandrel 102 (i.e., toward the mandrel cap 104). The force of the spring 144 acting on the forward or retraction side 141 of the piston 138 opposes this pressure force. It should be noted that the opposing spring force increases as the piston 138 moves forward to compress the spring 144. Thus, the pressure of drilling fluid in the actuation chamber 140 controls the position of the piston 138. The piston diameter is sized to receive force to move the slider element 122 and piston rod 124. The surface area of contact of the piston 138 and the fluid is preferably within the range of 1.0-10.0 $in^2$.

Forward motion of the piston 138 causes the piston rod 124 and the slider element 122 to move forward as well. As the slider element 122 moves forward to an actuation position, the ramps 126 move forward, causing the rollers 132 to roll up the inclined surfaces of the ramps. Thus, the forward motion of the slider element 122 and of the ramps 126 radially displaces the rollers 132 and the central sections 148 of the toes 112 outward. The toe support 106 slides in the aft direction to accommodate the outward flexure of the toes 112. The provision of a sliding toe support minimizes stress concentrations in the toes 112 and thus increases downhole life. In addition, the open end of the toe support 106 allows the portion of a failed toe to fall off of the gripper assembly, thus increasing the probability of retrieval of the tractor. The ends 114 and 116 of the toes 112 are pivotally secured to the toe supports 118 and 106, respectively, and thus maintain a constant radial position at all times.

Thus, the gripper assembly 100 is actuated by increasing the pressure in the actuation chamber 140 to a level such that the pressure force on the actuation side 139 of the piston 138 overcomes the force of the return spring 144 acting on the retraction side 141 of the piston. The gripper assembly 100 is retracted by decreasing the pressure in the actuation chamber 140 to a level such that the pressure force on the piston 138 is overcome by the force of the spring 144. The spring 144 then forces the piston 138, and thus the slider element 122, in the aft direction. This allows the rollers 136 to roll down the ramps 126 so that the toes 112 relax. When the slider element 122 slides back to a retraction position, the toes 112 are completely retracted and generally parallel to the mandrel 102. In addition, the toes 112 are somewhat self-retracting. The toes 112 comprise flexible beams that tend to straighten out independently. Thus, in certain embodiments of the present invention, the return spring 144 may be omitted. This is one of many significant advantages of the gripper assembly of the present invention over prior art grippers, such as the above-mentioned three-bar linkage design.

Another major advantage of the gripper assembly 100 over the prior art is that it can be actuated and retracted without substantial production of sliding friction. The rollers 132 roll along the ramps 126. The interaction of the rollers 132 and the ramps 126 provides relatively little impedance to the actuation and retraction of the gripper assembly. Though there is some rolling friction between the rollers 132 and the ramps 126, the impedance to actuation and retraction of the gripper assembly provided by rolling friction is much less than that caused by the sliding friction inherent in some prior art grippers.

In operation, the gripper assembly 100 slides along the body of the tractor, so that the tractor body can move longitudinally when the gripper assembly grips onto the inner surface of a borehole. In particular, the mandrel 102 slides along a shaft of the tractor body, such as the shafts 64 or 66 of FIG. 2. These shafts preferably contain fluid conduits for supplying drilling fluid to the various components of the tractor, such as the propulsion cylinders and the gripper assemblies. Preferably, the mandrel 102 contains an opening so that fluid in one or more of the fluid conduits in the shafts can flow into the actuation chamber 140. Valves within the remainder of the tractor preferably control the fluid pressure in the actuation chamber 140.

Advantageously, the toe support 106 on the forward end of the gripper assembly 100 permits the toes 112 to relax as the assembly is pulled out of a borehole from its aft end. While the gripper assembly is pulled out, the toe support 106 may be biased forward relative to the remainder of the assembly by the borehole formation, drilling fluids, rock cuttings, etc., so that it slides forward. This causes the toes 112 to retract from the borehole surface and facilitates removal of the assembly.

The gripper assembly 100 has seen substantial experimental verification of operation and fatigue life. An experimental version of the gripper assembly 100 has been operated and tested within steel pipe. These tests have demonstrated a fully functional operation with very little indication of wear after 32,000 cycles when the experimental gripper assembly was actuated with 1500 psi to produce 5000 lbs thrust and withstand 500-ft-lbs of torque. In addition, the experimental gripper assembly has "walked" down hole for 34,600 feet, drilled over 360 feet, operated for over 96 hours, and gripped formations of various compressive strengths ranging from 250-4000 psi. Under normal drilling conditions, the experimental gripper assembly has demonstrated resistance to contamination by rock cuttings. Under typical flow and pressure conditions, the experimental gripper assembly 100 has been shown to induce a flow-by pressure drop of less than 0.25 psi.

Gripper Assembly with Rollers on Slider Element

Figure 9:
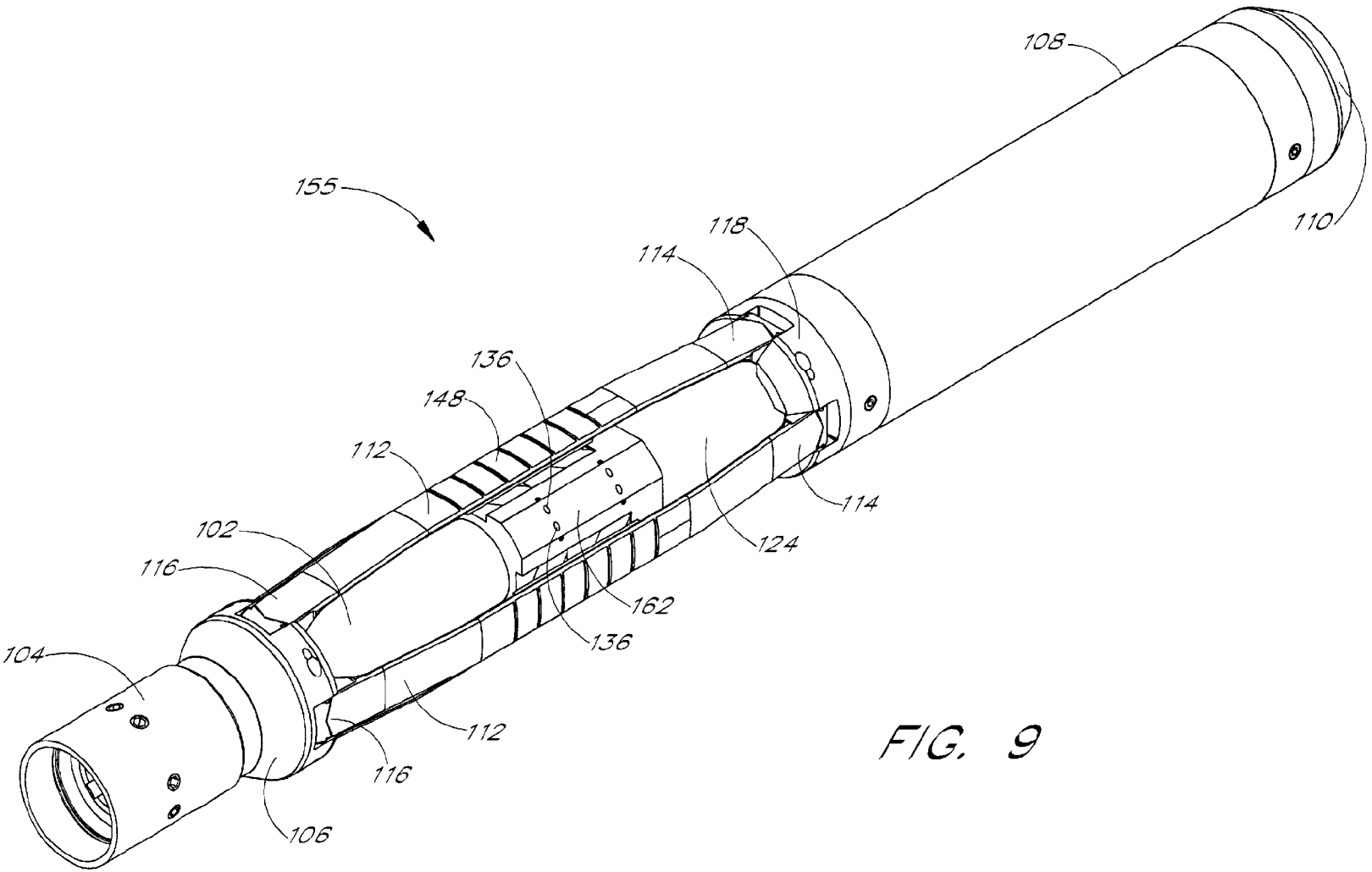
FIG. 9 is a perspective view of a gripper assembly having rollers secured to its slider element.
Figure 10:
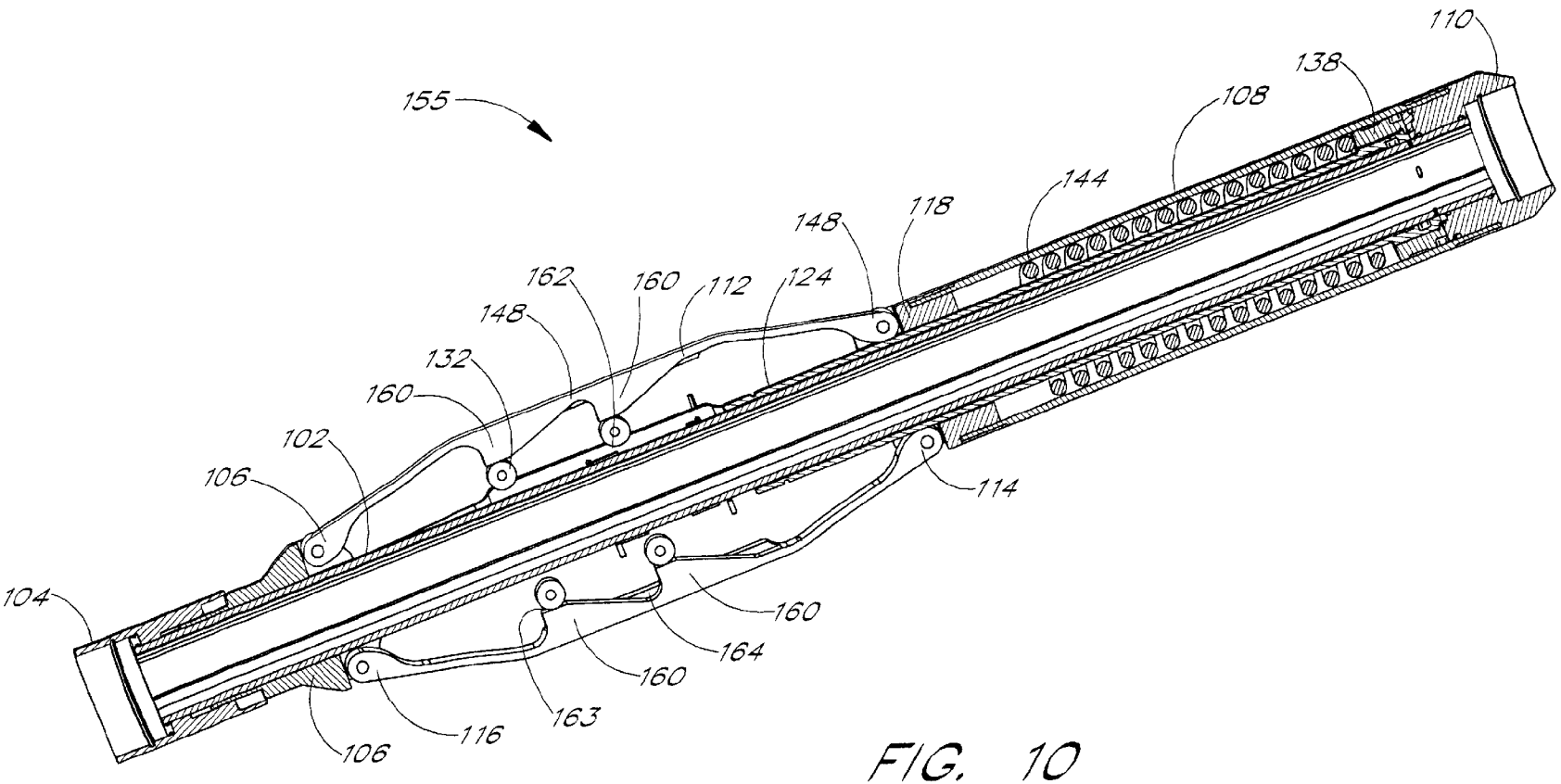
FIG. 10 is a longitudinal cross-sectional view of a gripper assembly having rollers secured to its slider element.

FIGS. 9 and 10 show a gripper assembly 155 according to an alternative embodiment of the invention. In this embodiment, the rollers 132 are located on a driver or slider element 162. The toes 112 include a driver interaction element that interacts with the driver to vary the radial position of the central sections 148 of the toes. In the illustrated embodiment, the driver interaction element comprises one or more ramps 160 on the interior surfaces of the central sections 148. Each ramp 160 slopes from a base 164 to a tip 163. The slider element 162 includes external recesses sized to receive the tips 163 of the ramps 160. The roller axles 136 extend transversely across these recesses, into holes in the sidewalls of the recesses. Preferably, the ends of the roller axles 136 reside within one or more lubrication reservoirs in the slider element 162. More preferably, such lubrication reservoirs are pressure-compensated by pressure compensation pistons, as described above in relation to the embodiments shown in FIGS. 3-8.

Although the gripper assembly 155 shown in FIGS. 9 and 10 has four toes 112, those of ordinary skill in the art will understand that any number of toes 112 can be included. However, it is preferred to include three toes 112, for more efficient and reliable contact with the inner surface of a passage or borehole. As in the previous embodiments, each toe 112 may include any number of ramps 160, although two are preferred. Desirably, there is at least one ramp 160 per roller 132.

The gripper assembly 155 shown in FIGS. 9 and 10 operates similarly to the gripper assembly 100 shown in the FIGS. 3-8. The actuation and retraction of the gripper assembly is controlled by the position of the piston 138 inside the cylinder 108. The fluid pressure in the actuation chamber 140 controls the position of the piston 138. Forward motion of the piston 138 causes the slider element 162 and the rollers 132 to move forward as well. The rollers roll against the inclined surfaces or slopes of the ramps 160, forcing the central regions 148 of the toes 112 radially outward.

Radial Loads Transmitted to Borehole

The gripper assemblies 100 and 155 described above and shown in FIGS. 3-10 provide significant advantages over the prior art. In particular, the gripper assemblies 100 and 155 can transmit significant radial loads onto the inner surface of a borehole to anchor itself, even when the central sections 148 of the toes 112 are only slightly radially displaced. The radial load applied to the borehole is generated by applying longitudinally directed fluid pressure forces onto the actuation side 139 of the piston 138. These fluid pressure forces cause the slider element 122, 162 to move forward, which causes the rollers 132 to roll against the ramps 126, 160 until the central sections 148 of the toes 112 are radially displaced and come into contact with the surface 42 of the borehole. The fluid pressure forces are transmitted through the rollers and ramps to the central sections 148 of the toes 112, and onto the borehole surface.

Figure 15:
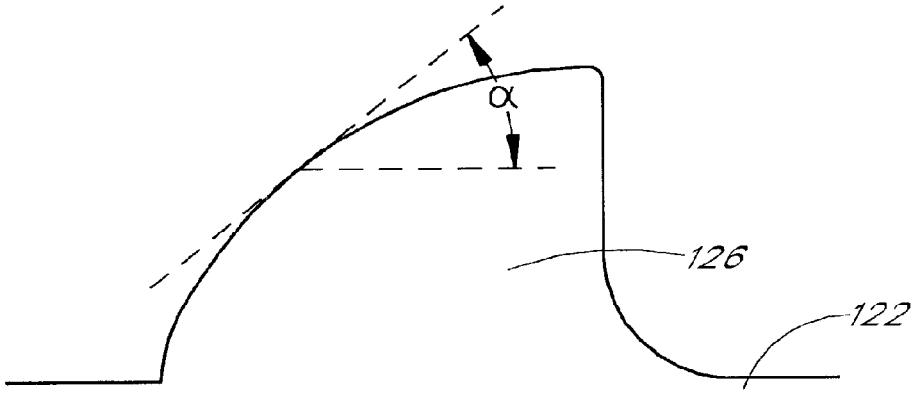
FIG. 15 is an enlarged view of a ramp of the gripper assembly shown in FIGS. 3-8.
Figure 16:
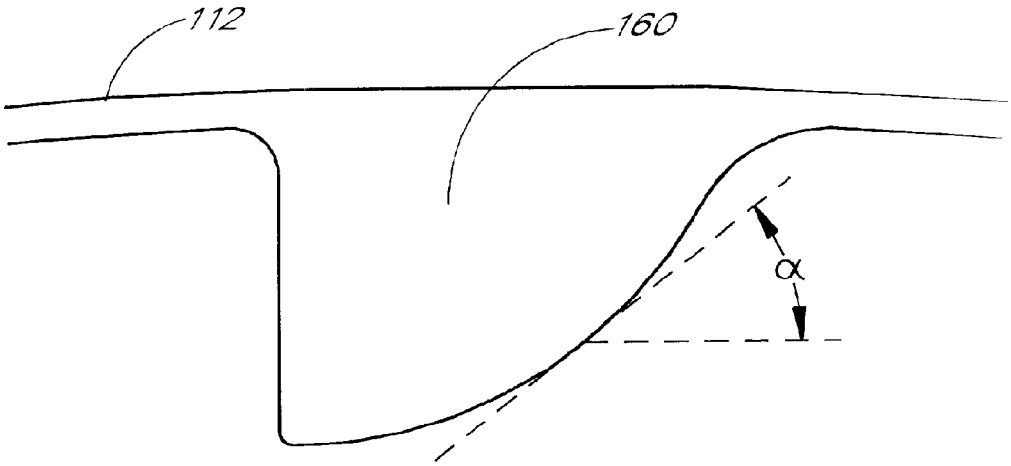
FIG. 16 is an enlarged view of a ramp of the gripper assembly shown in FIGS. 9 and 10.

FIGS. 15 and 16 illustrate the ramps 126 and 160 of the above-described gripper assemblies 100 and 155, respectively. As shown, the ramps can have a varying angle of inclination α with respect to the mandrel 102. The radial component of the force transmitted between the rollers 132 and the ramps 126, 160 is proportional to the sine of the angle of inclination α of the section of the ramps that the rollers are in contact with. With respect to the gripper assembly 100, at their inner radial levels 128 the ramps 126 have a non-zero angle of inclination α. With respect to the gripper assembly 155, at the bases 164 the ramps 160 have a non-zero angle of inclination α. Thus, when the gripper assembly begins to move from its retracted position to its actuated position, it is capable of transmitting significant radial load to the borehole surface. In small diameter boreholes, in which the toes 112 are displaced only slightly before coming into contact with the borehole surface, the angle α can be chosen so that the gripper assembly provides relatively greater radial load.

As noted above, the ramps 126, 160 can be shaped to have a varying or non-varying angle of inclination with respect to the mandrel 102. FIGS. 11-14 illustrate ramps 126, 160 of different shapes. The shape of the ramps may be modified as desired to suit the particular size of the borehole and the compression strength of the formation. Those of skill in the art will understand that the different ramps 126, 160 of a single gripper assembly may have different shapes. However, it is preferred that they have generally the same shape, so that the central portions 148 of the toes 112 are displaced at a more uniform rate.

Figure 11:
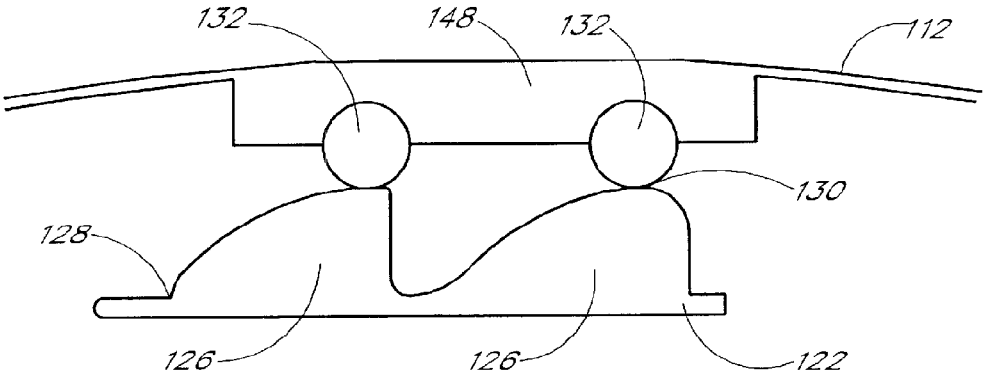
FIG. 11 is a side view of the slider element and a toe of the gripper assembly of FIGS. 3-8, the ramps having a generally convex shape with respect to the toe.
Figure 12:
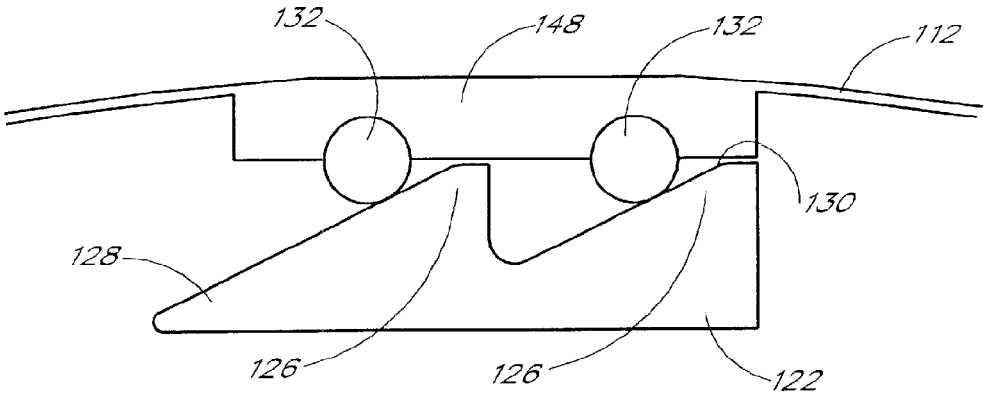
FIG. 12 is a side view of the slider element and a toe of the gripper assembly of FIGS. 3-8, the ramps having a generally concave shape with respect to the toe.

FIGS. 11 and 12 show different embodiments of the ramps 126, toes 112, and slider element 122 of the gripper assembly 100 shown in FIGS. 3-8. FIG. 11 shows an embodiment having ramps 126 that are convex with respect to the rollers 132 and the toes 112. This embodiment provides relatively faster initial radial displacement of the toes 112 caused by forward motion of the slider element 122. In addition, since the angle of inclination α of the ramps 126 at their inner radial level 128 is relatively high, the gripper assembly 100 transmits relatively high radial loads to the borehole when the toes 112 are only slightly radially displaced. In this embodiment, the rate of radial displacement of the toes 112 is initially high and then decreases as the ramps 126 move forward. FIG. 12 shows an embodiment having ramps 126 that have a uniform angle of inclination. In comparison to the embodiment of FIG. 11, this embodiment provides relatively slower initial radial displacement of the toes 112 caused by forward motion of the slider element 122. Also, since the angle of inclination α of the ramps 126 at their inner radial level 128 is relatively lower, the gripper assembly 100 transmits relatively lower radial loads to the borehole when the toes 112 are only slightly radially displaced. In this embodiment, the rate of radial displacement of the toes 112 remains constant as the ramps 126 move forward.

In addition to the embodiments shown in FIGS. 11 and 12, the ramps 126 may alternatively be concave with respect to the rollers 132 and the toes 112. Also, many other configurations are possible. The angle α can be varied as desired to control the mechanical advantage wedging force of the ramps 126 over a specific range of displacement of the toes 112. Preferably, at the inner radial positions 128 of the ramps 126, α is within the range of 1° to 45°. Preferably, at the outer radial positions 130 of the ramps 126, α is within the range of 0° to 30°. For the embodiment of FIG. 11, α is preferably approximately 30° at the outer radial position 130.

Figure 13:
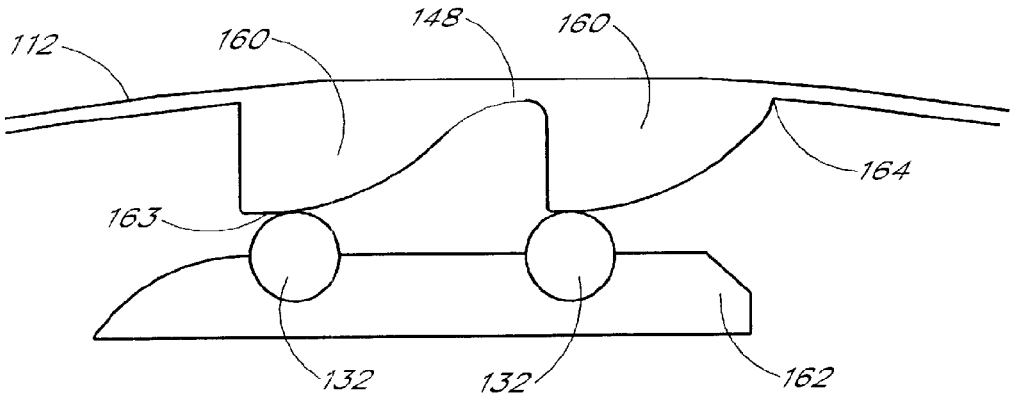
FIG. 13 is a side view of the slider element and a toe of the gripper assembly of FIGS. 9 and 10, the ramps having a generally convex shape with respect to the mandrel.
Figure 14:
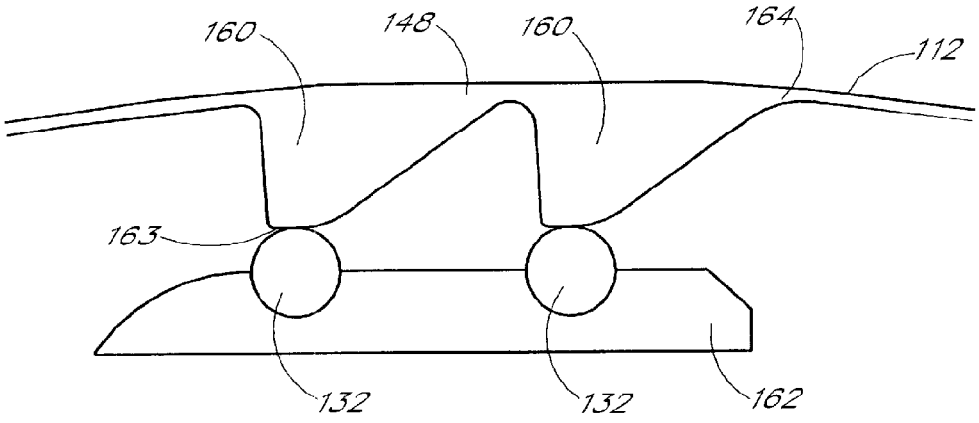
FIG. 14 is a side view of the slider element and a toe of the gripper assembly of FIGS. 9 and 10, the ramps having a generally concave shape with respect to the mandrel.

FIGS. 13 and 14 show different embodiments of the ramps 160, toes 112, and slider element 162 of the gripper assembly 155 shown in FIGS. 9 and 10. FIG. 13 shows an embodiment having ramps 160 that are convex with respect to the mandrel 102. This embodiment provides relatively faster initial radial displacement of the toes 112 caused by forward motion of the slider element 162. In addition, since the angle of inclination α of the ramps 160 at their bases 164 is relatively high, the gripper assembly 155 transmits relatively high radial loads to the borehole when the toes 112 are only slightly radially displaced. In this embodiment, the rate of radial displacement of the toes 112 is initially high and then decreases as the slider element 162 moves forward. FIG. 14 shows an embodiment having ramps 160 that have a uniform angle of inclination. In comparison to the embodiment of FIG. 13, this embodiment provides relatively slower initial radial displacement of the toes 112 caused by forward motion of the slider element 162. Also, since the angle of inclination α of the ramps 160 at their tips 163 is relatively lower, the gripper assembly 155 transmits relatively lower radial loads to the borehole when the toes 112 are only slightly radially displaced.

In addition to the embodiments shown in FIGS. 13 and 14, the ramps 160 may alternatively be concave with respect to the mandrel 102. Also, many other configurations are possible. The angle α can be varied as desired to control the mechanical advantage wedging force of the ramps 160 over a specific range of displacement of the toes 112. Preferably, at the bases 164 of the ramps 160, α is within the range of 1° to 45°. Preferably, at the tips 163 of the ramps 160, α is within the range of 0° to 30°.

Gripper Assembly with Toggles

Figure 17:
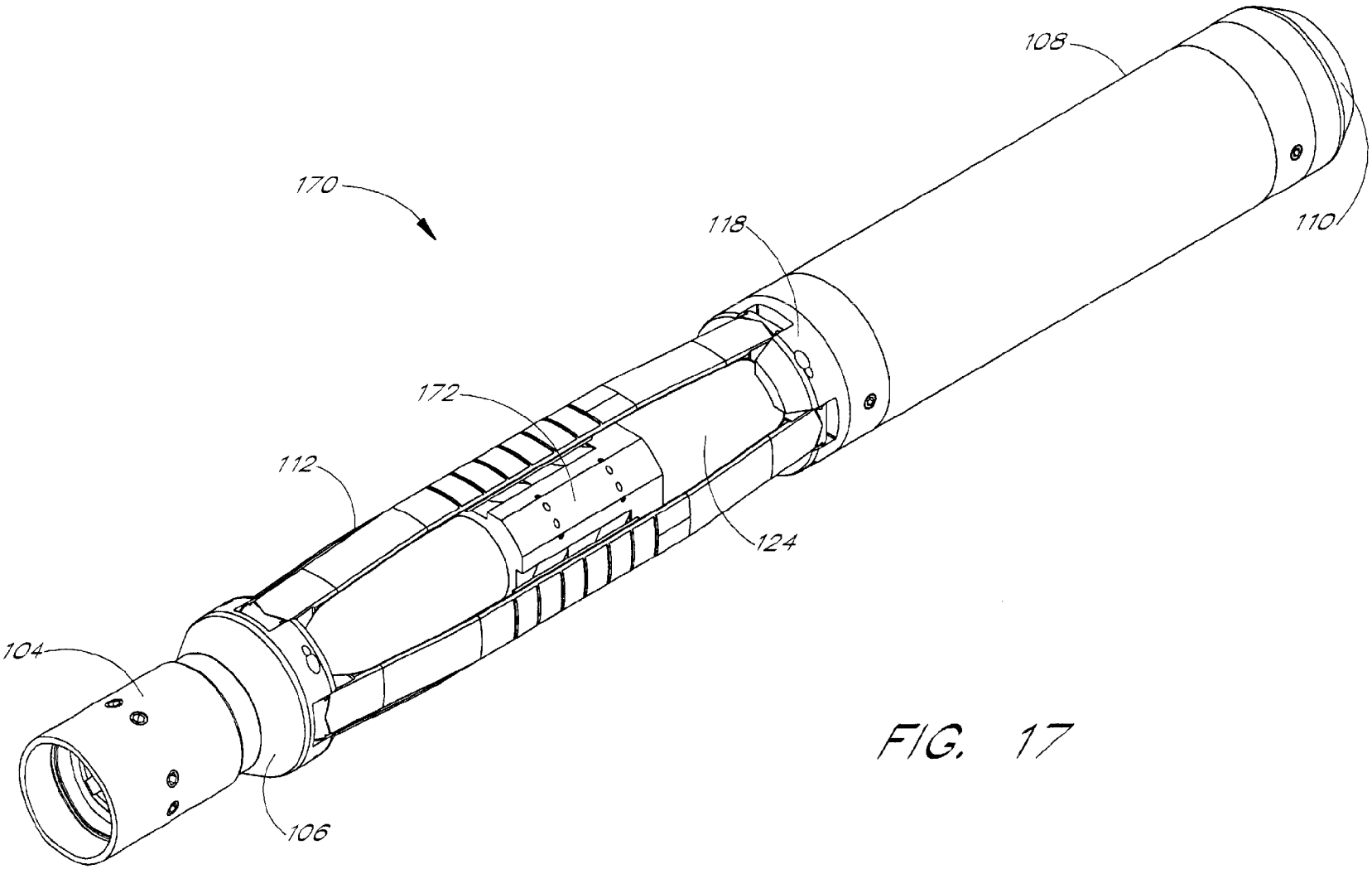
FIG. 17 is a perspective view of a retracted gripper assembly having toggles for causing radial displacement of the toes.
Figure 18:
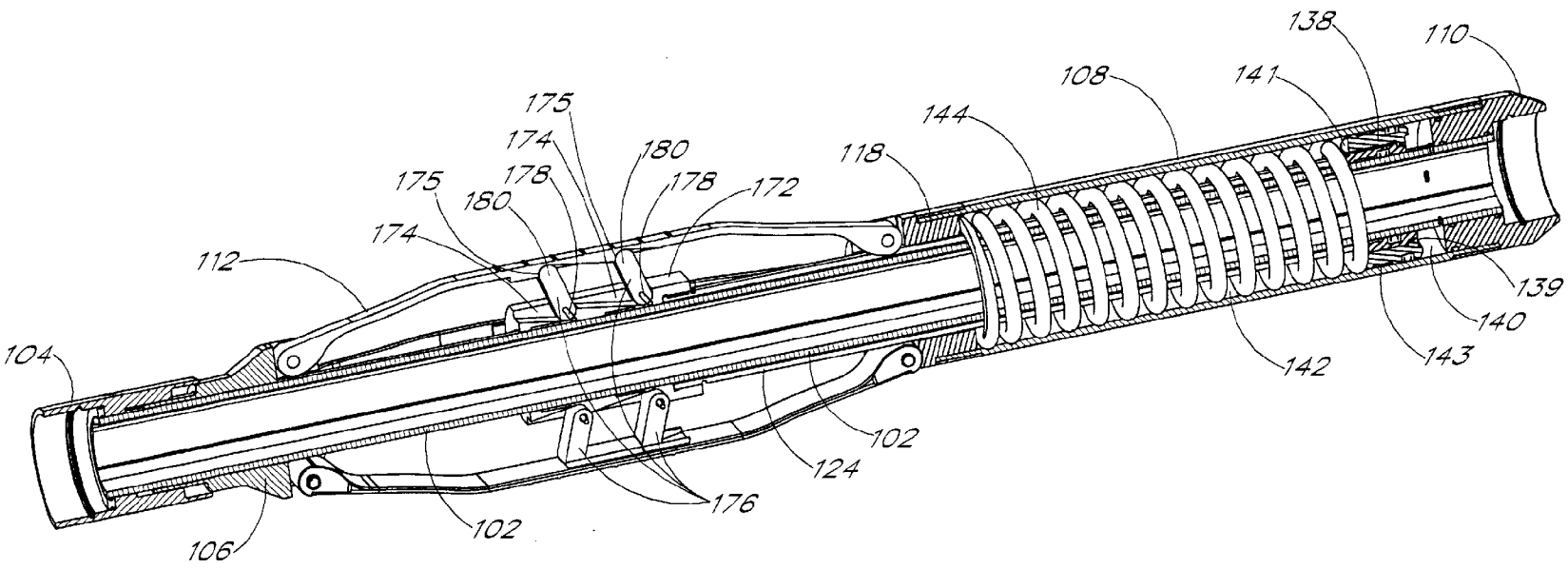
FIG. 18 is a longitudinal cross-sectional view of the gripper assembly of FIG. 17, shown in an actuated or gripping position.

FIGS. 17 and 18 show a gripper assembly 170 having toggles 176 for radially displacing the toes 112. A slider element 172 has toggle recesses 174 configured to receive ends of the toggles 176. Similarly, the toes 112 include toggle recesses 175 also configured to receive ends of the toggles. Each toggle 176 has a first end 178 received within a recess 174 and rotatably maintained on the slider element 172. Each toggle 176 also has a second end 180 received within a recess 175 and rotatably maintained on one of the toes 112. The ends 178 and 180 of the toggles 176 can be pivotally secured to the slider element 172 and the toes 112, such as by dowel pins or hinges connected to the slider element 162 and the toes 112. Those of ordinary skill in the art will understand that the recesses 174 and 175 are not necessary. The purpose of the toggles 176 is to rotate and thereby radially displace the toes 112. This may be accomplished without recesses for the toggle ends, such as by pivoted connections of the ends.

In the illustrated embodiment, there are two toggles 176 for each toe 112. Those of ordinary skill in the art will understand that any number of toggles can be provided for each toe 112. However, it is preferred to have two toggles having second ends 180 generally at or near the ends of the central section 148 of each toe 112. This configuration results in a more linear shape of the central section 148 when the gripper assembly 170 is actuated to grip against a borehole surface. This results in more surface area of contact between the toe 112 and the borehole, for better gripping and more efficient transmission of loads onto the borehole surface.

The gripper assembly 170 operates similarly to the gripper assemblies 100 and 155 described above. The gripper assembly 170 has an actuated position in which the toes 112 are flexed radially outward, and a retracted position in which the toes 112 are relaxed. In the retracted position, the toggles 176 are oriented substantially parallel to the mandrel 102, so that the second ends 180 are relatively near the surface of the mandrel. As the piston 138, piston rod 124, and slider element 172 move forward, the first ends 178 of the toggles 176 move forward as well. However, the second ends 180 of the toggles are prevented from moving forward by the recesses 175 on the toes 112. Thus, as the slider element 172 moves forward, the toggles 176 rotate outward so that they are oriented diagonally or even nearly perpendicular to the mandrel 102. As the toggles 176 rotate, the second ends 180 move radially outward, which causes radial displacement of the central sections 148 of the toes 112. This corresponds to the actuated position of the gripper assembly 170. If the piston 138 moves back toward the aft end of the mandrel 102, the toggles 176 rotate back to their original position, substantially parallel to the mandrel 102.

Compared to the gripper assemblies 100 and 155 described above, the gripper assembly 170 does not transmit significant radial loads onto the borehole surface when the toes 112 are only slightly radially displaced. However, the gripper assembly 170 comprises a significant improvement over the three-bar linkage gripper design of the prior art. The toes 112 of the gripper assembly 155 comprise continuous beams, as opposed to multi-bar linkages. Continuous beams have significantly greater torsional rigidity than multi-bar linkages, due to the absence of hinges, pin joints, or axles connecting different sections of the toe. Thus, the gripper assembly 170 is much more resistant to undesired rotation or twisting when it is actuated and in contact with the borehole surface. Also, continuous beams involve few if any stress concentrations and thus tend to last longer than linkages. Another advantage of the gripper assembly 170 over the multi-bar linkage design is that the toggles 176 provide radial force at the central sections 148 of the toes 112. In contrast, the multi-bar linkage design involves moving together opposite ends of the linkage to force a central link radially outward against the borehole surface. Thus, the gripper assembly 170 involves a more direct application of force at the central section 148 of the toe 112, which contacts the borehole surface. Another advantage of the gripper assembly 170 is that it can be actuated and retracted substantially without any sliding friction.

Double-Acting Piston

Figure 19:
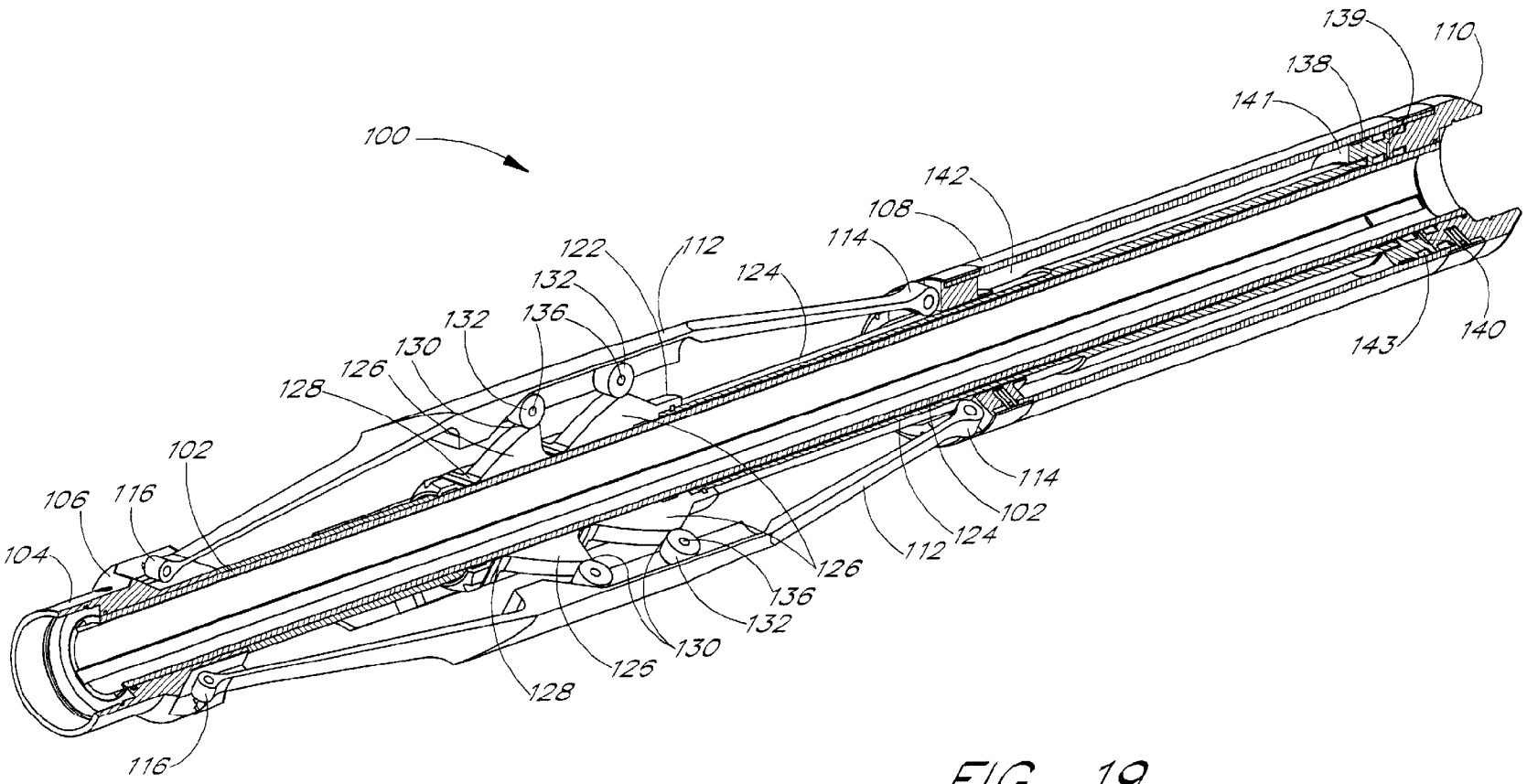
FIG. 19 is a perspective partially cut-away view of a gripper assembly having a double-acting piston powered on both sides by pressurized fluid.

With regard to all of the above-described gripper assemblies 100, 155, and 170, the return spring 144 may be eliminated. Instead, the piston 138 can be actuated on both sides by fluid pressure. FIG. 19 shows a gripper assembly 190 that is similar to the gripper assembly 100 shown in FIG. 3-8, with the exception that the assembly 190 utilizes a double-acting piston 138. In this embodiment, both the actuation chamber 140 and the retraction chamber 142 can be supplied with pressurized fluid that acts on the double-acting piston 138. The shaft upon which the gripper assembly 190 slides preferably has additional flow conduits for providing pressurized hydraulic or drilling fluid to the retraction chamber 142. For this reason, gripper assemblies having double-acting pistons are more suitably implemented in larger size tractors, preferably greater than 4.75 inches in diameter. In addition, the tractor preferably includes additional valves to control the fluid delivery to the actuation and retraction chambers 140 and 142, respectively. It is believed that the application of direct pressure to the retraction side 141 of the piston 138 will make it easier for the gripper assembly to disengage from a borehole surface, thus minimizing the risk of the gripper assembly "sticking" or "locking up" against the borehole.

To actuate the gripper assembly 190, fluid is discharged from the retraction chamber 142 and delivered to the actuation chamber 140. To retract the gripper assembly 190, fluid is discharged from the actuation chamber 140 and delivered to the retraction chamber 142. In one embodiment, the surface area of the retraction side 141 of the piston 138 is greater than the surface area of the actuation side 139, so that the gripper assembly has a tendency to retract faster than it actuates. In this embodiment, the retraction force to release the gripper assembly from the borehole surface will be greater than the actuation force that was used to actuate it. This provides additional safety to assure release of the gripper assembly from the hole wall. Preferably, the ratio of the surface area of the retraction side 141 to the surface area of the actuation side 139 is between 1:1 to 6:1, with a preferred ratio being 2:1.

Failsafe Operation

In a preferred embodiment, the tractor 50 (FIGS. 1 and 2) includes a failsafe assembly and operation to assure that the gripper assembly retracts from the borehole surface. The failsafe operation prevents undesired anchoring of the tractor to the borehole surface and permits retrieval of the tractor if the tractor's control system malfunctions or power is lost. For example, suppose that control of the tractor is lost when high-pressure fluid is delivered to the actuation chamber 140 of the gripper assembly 100 (FIG. 4). Without a failsafe assembly, the pressurized fluid could possibly maintain the slider element 122, 162, 172 in its actuation position so that the gripper assembly remains actuated and "stuck" on the borehole surface. In this condition, it can be very difficult to remove the tractor from the borehole. The failsafe assembly and operation substantially prevents this possibility.

Figure 20:
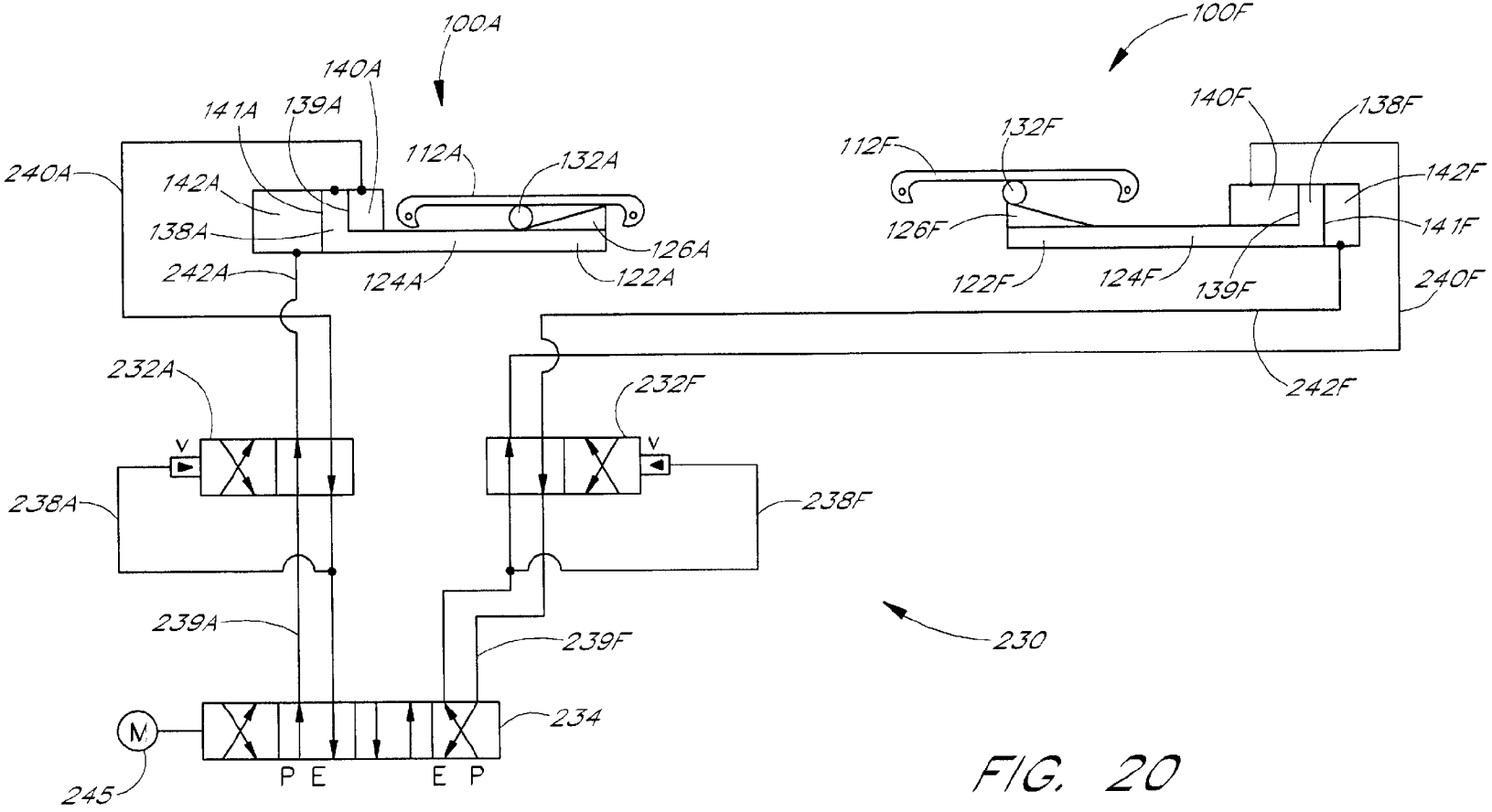
FIG. 20 is a schematic diagram illustrating the failsafe operation of a tractor having a gripper assembly according to the present invention.
Figure 21:
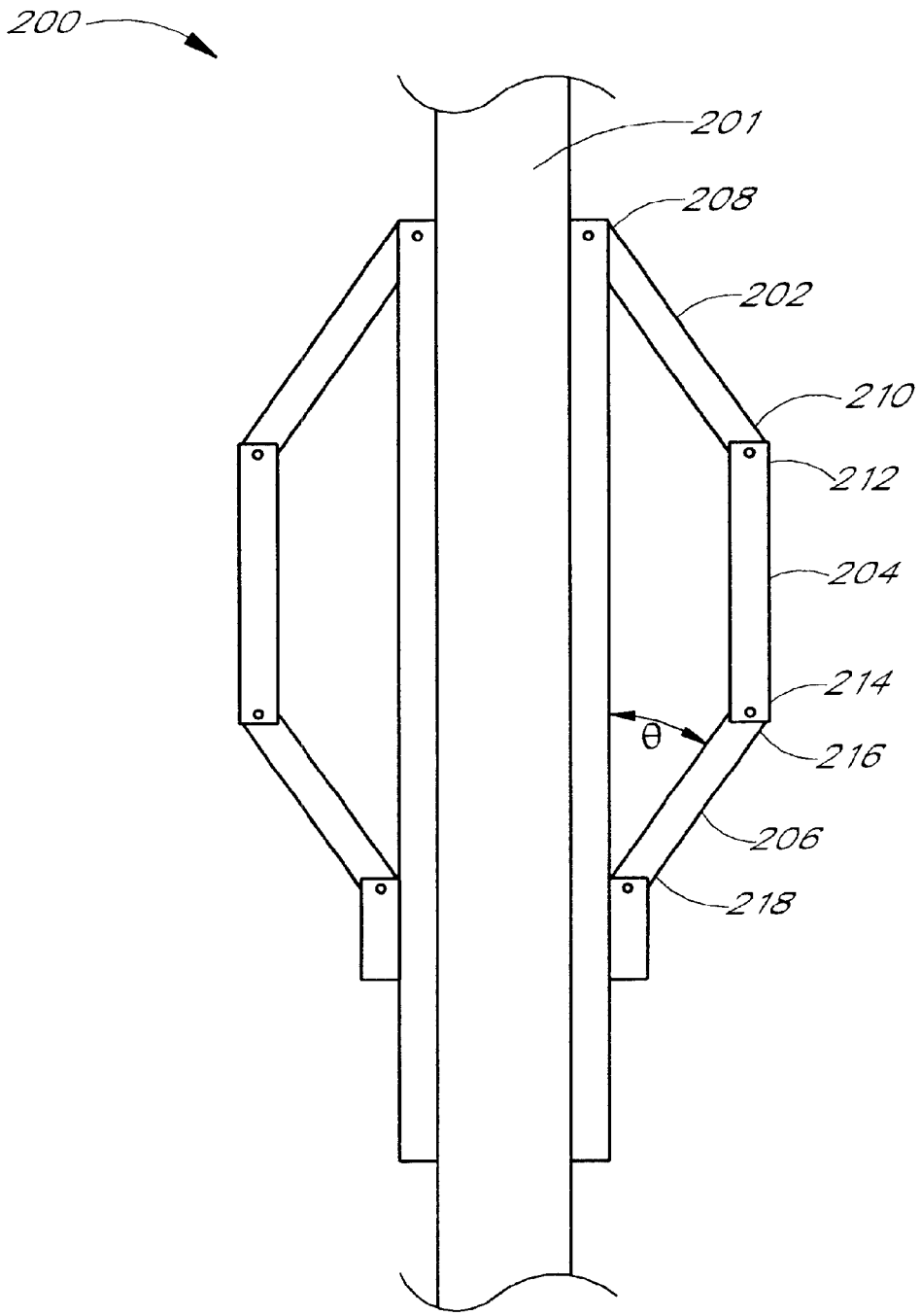
FIG. 21 (PRIOR ART)
FIG. 21 is a schematic diagram illustrating a three-bar linkage gripper of the prior art.

FIG. 20 schematically represents and describes a failsafe assembly 230 and failsafe operation of a tractor including two gripper assemblies 100 (FIGS. 3-8) according to the present invention. Specifically, the tractor includes an aft gripper assembly 100A and a forward gripper assembly 100F. The gripper assemblies 100A, 100F include toes 112A, 112F, slider elements 122A, 122F, ramps 126A, 126F, rollers 132A, 132F, piston rods 124A, 124F, and double-acting pistons 138A, 138F, as described above. Although illustrated in connection with a tractor having gripper assemblies 100 according to the embodiment shown in FIGS. 3-8, the failsafe assembly 230 can be implemented with other gripper assembly embodiments, such as the assemblies 155 and 170 described above. In addition, the failsafe assembly described herein can be implemented with a variety of other types of grippers and gripper assemblies.

The failsafe assembly 230 comprises failsafe valves 232A and 232F. The valve 232A controls the fluid input and output of the gripper assembly 100A, while the valve 232F controls the fluid input and output of the gripper assembly 100F. Preferably, the tractor includes one failsafe valve 232 for each gripper assembly 100. In one embodiment, the failsafe valves 232A/F are two-position, two-way spool valves. These valves are preferably formed of materials that resist wear and erosion caused by exposure to drilling fluids, such as tungsten carbide.

In a preferred embodiment, the failsafe valves 232A/F are maintained in first positions (shown in FIG. 20) by restraints, shown symbolically in FIG. 20 by the letter "V," which are in contact with the failsafe valves. In one embodiment, the restraints V comprise dents, protrusions, or the like on the surface of the valve spools, which mechanically and/or frictionally engage corresponding protrusions or dents in the spool housings to constrain the valve spools in their first (shown) positions. In other embodiments, the failsafe valves 232A/F may be biased toward the first positions by other means, such as coil springs, leaf springs, or the like. Ends of the failsafe valves 232A/F are exposed to fluid lines or chambers 238A and 238F, respectively. The fluid in the chambers 238A/F exerts a pressure force onto the valves 232A/F, which tends to shift the valves 232A/F to second positions thereof. In FIG. 20, the second position of the valve 232A is that in which it is shifted to the right, and the second position of the valve 232F is that in which it is shifted to the left. The fluid pressure forces exerted from chambers 238A/F are opposed by the restraining force of the restraints V. Preferably, the restraints V are configured to release the valves 232A/F when the pressure forces exerted by the fluid in chambers 238A/F exceeds a particular threshold, allowing the valves 232A/F to shift to their second positions.

One advantage of restraints V comprising dents or protrusions without a spring return function on the failsafe valves 238A/F is that once the valves shift to their second positions, they will not return to their first positions while the tool is downhole. Advantageously, the gripper assemblies will remain retracted to facilitate removal of the tool from the hole.

The failsafe valve 232A is fluidly connected to the actuation and retraction chambers 140A and 142A. In its first position (shown in FIG. 20), the failsafe valve 232A permits fluid flow between chambers 238A and 240A, and also between chambers 239A and chamber 242A. In the second position of the failsafe valve 232A (shifted to the right), it permits fluid flow between chambers 238A and 242A, and also between chambers 239A and 240A. Similarly, the failsafe valve 232F is fluidly connected to the actuation and retraction chambers 140F and 142F. In its first position (shown in FIG. 20), the failsafe valve 232F permits fluid flow between chambers 238F and 240F, and also between chambers 239F and chamber 242F. In the second position of the failsafe valve 232F, it permits fluid flow between chambers 238F and 242F, and also between chambers 239F and 240F.

The illustrated configuration also includes a motorized packerfoot valve 234, preferably a six-way spool valve. The packerfoot valve 234 controls the actuation and retraction of the gripper assemblies 100A/F by supplying fluid alternately thereto. The position of the packerfoot valve 234 is controlled by a motor 245. The packerfoot valve 234 fluidly communicates with a source of high pressure input fluid, typically drilling fluid pumped from the surface down to the tractor through the drill string. The packerfoot valve 234 also fluidly communicates with the annulus 40 (FIG. 1). In FIG. 20, the interfaces between valve 234 and the high pressure fluid are labeled "P", and the interfaces between valve 234 and the annulus are labeled "E". Movement of the tractor is controlled by timing the motion of the packerfoot valve 234 so as to cause the gripper assemblies 100A/F to alternate between actuated and retracted positions while the tractor executes longitudinal strokes.

In the position shown in FIG. 20, the packerfoot valve 234 directs high pressure fluid to the chambers 239A and 238F and also connects the chambers 238A and 239F to the annulus. Thus, the chambers 239A and 238F are viewed as "high pressure fluid chambers" and the chambers 238A and 239F as "exhaust chambers." It will be appreciated that these characterizations change with the position of the packerfoot valve 234. If the packerfoot valve 234 shifts to the right in FIG. 20, then the chambers 239A and 238F will become exhaust chambers, and the chambers 238A and 239F will become high pressure fluid chambers. As used herein, the term "chamber" is not intended to suggest any particular shape or configuration.

In the position shown in FIG. 20, high pressure input fluid flows through the packerfoot valve 234, through high pressure fluid chamber 239A, through the failsafe valve 232A, through chamber 242A, and into the retraction chamber 142A of the gripper assembly 100A. This fluid acts on the retraction side 141A of the piston 138A to retract the gripper assembly 100A. At the same time, fluid in the actuation chamber 140A is free to flow through chamber 240A, through the failsafe valve 232A, through the exhaust chamber 238A, and through the packerfoot valve 234 into the annulus.

Also, in the position shown in FIG. 20, high pressure input fluid flows through the packerfoot valve 234, through high pressure fluid chamber 238F, through the failsafe valve 232F, through chamber 240F, and into the actuation chamber 140F of the gripper assembly 100F. This fluid acts on the actuation side 139F of the piston 138F to actuate the gripper assembly 100F. At the same time, fluid in the retraction chamber 142F is free to flow through chamber 242F, through the failsafe valve 232F, through the exhaust chamber 239F, and through the packerfoot valve 234 into the annulus.

Thus, in the illustrated position of the valves the aft gripper assembly 100A is retracted and the forward gripper assembly 100F is actuated. Those of ordinary skill in the art will understand that if the packerfoot value 234 is shifted to the right in FIG. 20, the aft gripper assembly 100A will be actuated and the forward gripper assembly 100F will be retracted. Now, in the position shown in FIG. 20, suppose that power and/or control of the tractor is suddenly lost. Pressure will build in the high pressure fluid chamber 238F until it overcomes the restraining force of the restraint V acting on the failsafe valve 232F, causing the valve 232F to shift from its first position to its second position. In this position the pressurized fluid flows into the retraction chamber 142F of the gripper assembly 100F, causing the assembly to retract and release from the borehole wall. The gripper assembly 100A remains retracted, as pressure buildup in the high pressure fluid chamber 239A does not affect the position of the failsafe valve 232A. Thus, both gripper assemblies are retracted, facilitating removal of the tractor from the borehole, even when control of the tractor is lost.

The same is true when the packerfoot valve 234 shifts so that the aft gripper assembly 100A is actuated and the forward gripper assembly 100F is retracted. In that case, loss of electrical control of the tractor will result in pressure buildup in the high pressure fluid chamber 238A. This will cause the failsafe valve 232A to switch positions so that high pressure fluid flows into the retraction chamber 142A of the gripper assembly 100A. The threshold pressure at which the failsafe valves switch their positions can be controlled by careful selection of the physical properties (geometry, materials, etc.) of the restraints V.

Materials for the Gripper Assemblies

The above-described gripper assemblies may utilize several different materials. Certain tractors may use magnetic sensors, such as magnetometers for measuring displacement. In such tractors, it is preferred to use non-magnetic materials to minimize any interference with the operation of the sensors. In other tractors, it may be preferred to use magnetic materials. In the gripper assemblies described above, the toes 112 are preferably made of a flexible high strength, fracture resistant, long fatigue life material. Non-magnetic candidate materials for the toes 112 include copper-beryllium, Inconel, and suitable titanium or titanium alloy. Other possible materials include nickel alloys and high strength steels. The exterior of the toes 112 may be coated with abrasion resistant materials, such as various plasma spray coatings of tungsten carbide, titanium carbide, and similar materials.

The mandrel 102, mandrel caps 104 and 110, piston rod 124, and cylinder 108 are preferably made of high strength magnetic metals such as steel or stainless steel, or non-magnetic materials such as copper-beryllium or titanium. The return spring 144 is preferably made of stainless steel that may be cold set to achieve proper spring characteristics. The rollers 132 are preferably made of copper-beryllium. The axles 136 of the rollers 132 are preferably made of a high strength material such as MP-35N alloy. The seal 143 for the piston 138 can be formed from various types of materials, but is preferably compatible with the drilling fluids. Examples of acceptable seal materials that are compatible with some drilling muds include HNBR, Viton, and Aflas, among others. The piston 138 is preferably compatible with drilling fluids. Candidate materials for the piston 138 include high strength, long life, and corrosion-resistant materials such as copper beryllium alloys, nickel alloys, nickel-cobalt-chromium alloys, and others. In addition, the piston 138 may be formed of steel, stainless steel, copper-beryllium, titanium, Teflon-like material, and other materials. Portions of the gripper assembly may be coated. For example the piston rods 124 and the mandrel 102 may be coated with chrome, nickel, multiple coatings of nickel and chrome, or other suitable abrasion resistant materials.

The ramps 126 (FIG. 4) and 160 (FIG. 10) are preferably made of copper-beryllium. Endurance tests of copper-beryllium ramp materials with copper-beryllium rollers in the presence of drilling mud have demonstrated life beyond 10,000 cycles. Similar tests of copper-beryllium ramps with copper-beryllium rollers operating in air have shown life greater than 32,000 cycles.

The toggles 176 of the gripper assembly 170 can be made of various materials compatible with the toes 112. The toggles are preferably made of materials that are not chemically reactive in the presence of water, diesel oil, or other downhole fluids. Also, the materials are preferably abrasion and fretting resistant and have high compressive strength (80-200 ksi). Candidate materials include steel, tungsten carbide infiltrates, nickel steels, Inconel alloys, and others. The toggles may be coated with materials to prevent wear and decrease fretting or galling. Such coatings can be sprayed or otherwise applied (e.g., EB welded or diffusion bonded) to the toggles.

Performance

Many of the performance capabilities of the above-described gripper assemblies will depend on their physical and geometric characteristics. With specific regard to the gripper assemblies 100 and 155, the assembly can be adjusted to meet the requirements of gripping force and torque resistance. In one embodiment, the gripper assembly has a diameter of 4.40 inches in the retracted position and is approximately 42 inches long. This embodiment can be operated with fluid pressurized up to 2000 psi, can provide up to 6000 pounds of gripping force, and can resist up to 1000 foot-pounds of torque without slippage between the toes 112 and the borehole surface. In this embodiment, the toes 112 are designed to withstand approximately 50,000 cycles without failure.

The gripper assemblies of the present invention can be configured to operate over a range of diameters. In the above-mentioned embodiment of the gripper assemblies 100 and 155 having a collapsed diameter of 4.40 inches, the toes 112 can expand radially so that the assembly has a diameter of 5.9 inches. Other configurations of the design can have expansion up to 6.0 inches. It is expected that by varying the size of the toe 112 and the toe supports 106 and 118, a practical range for the gripper is 3.0 to 13.375 inches.

The size of the central sections 148 of the toes 112 can be varied to suit the compressive strength of the earth formation through which the tractor moves. For example, wider toes 112 may be desired in softer formations, such as "gumbo" shale of the Gulf of Mexico. The number of toes 112 can also be altered to meet specific requirement for "flow-by" of the returning drilling fluid. In a preferred embodiment, three toes 112 are provided, which assures that the loads will be distributed to three contact points on the borehole surface. In comparison, a four-toed configuration could result in only two points of contact in oval-shaped passages. Testing has demonstrated that the preferred configuration can safely operate in shales with compressive strengths as low as 250 psi. Alternative configurations can operate in shale with compressive strength as low as 150 psi.

The pressure compensation and lubrication system shown in FIGS. 7 and 8 provides significant advantages. Experimental tests were conducted with various configurations of rollers 132, rolling surfaces, axles 136, and coatings. One experiment used copper-beryllium rollers 132 and MP-35N axles 136. The axles 136 and journals (i.e., the ends of the axles 136) were coated with NPI425. The rollers 132 were rolled against copper-beryllium plate while the rollers 132 were submerged in drilling mud. In this experiment, however, the axles 136 and journals were not submerged in the mud. Under these conditions, the roller assembly sustained over 10,004 cycles without failure. A similar test used copper-beryllium rollers 132 and MP-35N axles 136 coated with Dicronite. The rollers 132 were rolled against copper-beryllium plate. In this experiment, the axles 136, rollers 132, and journals were submerged in drilling mud. The roller assembly failed after only 250 cycles. Hence, experimental data suggests that the presence of drilling mud on the axles 136 and journals dramatically reduces operational life. By preventing contact between the drilling fluid and the axles 136 and journals, the pressure compensation and lubrication system contributes to a longer life of the gripper assembly.

The above-described gripper assemblies are capable of surviving free expansion in open holes. The assemblies are designed to reach a maximum size and then cease expansion. This is because the ramps 126, 160 and the toggles 176 are of limited size and cannot radially displace the toes 112 beyond a certain extent. Moreover, the size of the ramps and toggles can be controlled to ensure that the toes 112 will not be radially displaced beyond a point at which damage may occur. Thus, potential damage due to free expansion is prevented.

The metallic toes 112 formed of copper-beryllium have a very long fatigue life compared to prior art gripper assemblies. The fatigue life of the toes 112 is greater than 50,000 cycles, producing greater downhole operational life of the gripper assembly. Further, the shape of the toes 112 provides very little resistance to flow-by, i.e., drilling fluid returning from the drill bit up through the annulus 40 (FIG. 1) between the tractor and the borehole. Advantageously, the design of the gripper assembly allows returning drilling fluid to easily pass the gripper assembly without excessive pressure drop. Further, the gripper assembly does not significantly cause drill cuttings in the returning fluid to drop out of the main fluid path. Drilling experiments in test formations containing significant amounts of small diameter gravel have shown that deactivation of the gripper assembly clears the gripper assembly of built-up debris and allows further drilling.

Another advantage of the gripper assemblies of the present invention is that they provide relatively uniform borehole wall gripping. The gripping force is proportional to the actuation fluid pressure. Thus, at higher operating pressures, the gripper assemblies will grip the borehole wall more tightly.

Another advantage is that a certain degree of plastic deformation of the toes 112 does not substantially affect performance. It has been determined that when the gripper assembly is halfway in a passage or borehole, the portion of the toes 112 that are outside of the passage and are permitted to freely expand may experience a slight amount of plastic deformation. In particular, each toe 112 may plastically deform (i.e. bend) slightly in the sections 150 (FIG. 7). However, experiments have shown that such plastic deformation does not substantially affect the operational life and performance of the gripper assembly.

In summary, the gripper assemblies of various embodiments of the present invention provide significant utility and advantage. They are relatively easy to manufacture and install onto a variety of different types of tractors. They are capable of a wide range of expansion from their retracted to their actuated positions. They can be actuated with little or no production of sliding friction, and thus are capable of transmitting larger radial loads onto a borehole surface. They permit rapid actuation and retraction, and can safely and reliably disengage from the inner surface of a passage without getting stuck. They effectively resist contamination from drilling fluids and other sources. They are not damaged by unconstrained expansion, as may be experienced in washouts downhole. They are able to operate in harsh downhole conditions, including pressures as high as 16,000 psi and temperatures as high as 300° F. They are able to simultaneously resist thrusting or drag forces as well as torque from drilling, and have a long fatigue life under combined loads. They are equipped with a failsafe operation that assures disengagement from the borehole wall under drilling conditions. They have a very cost-effective life, estimated to be at least 100-150 hours of downhole operation. They can be immediately installed onto existing tractors without retrofitting.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Further, the various features of this invention can be used alone, or in combination with other features of this invention other than as expressly described above. Thus, it is intended that the scope of the present invention herein disclosed should not be limited by the particular disclosed embodiments described above, but should be determined only by a fair reading of the claims that follow.

What is claimed is:

1. A tool for use within a passage, comprising:

an elongated body;

a gripper assembly for anchoring the tool within the passage, the gripper assembly having a movement-limiting mode in which the gripper assembly substantially prevents movement between the gripper assembly and an inner surface of the passage, the gripper assembly also having a movement-permissive mode in which the gripper assembly allows substantially free relative movement between the gripper assembly and the inner surface of the passage, the gripper assembly comprising:

an elongated gripper portion extending along a length of the body, the gripper portion having opposing ends rotatably engaged with elements of the gripper assembly;

a slider element configured to slide longitudinally with respect to the body;

a ramp; and a roller engaged with the gripper portion in a manner allowing the roller to rotate with respect to the gripper portion;

wherein longitudinal movement of the slider element with respect to the body causes the roller to roll along the ramp, which in turn causes the roller and a portion of the gripper portion to move radially.

2. The tool of claim 1, wherein the opposing ends of the gripper portion have substantially constant radial positions as the slider element moves longitudinally with respect to the body.

3. The tool of claim 2, wherein the gripper portion comprises a single beam having said opposing ends.

4. The tool of claim 1, wherein the ramp is on the slider element.

5. The tool of claim 1, wherein the roller is engaged with a central section of the gripper portion.

6. The tool of claim 1, wherein:

the elongated gripper portion is one of a plurality of elongated gripper portions of the gripper assembly, each of the gripper portions extending along a length of the body, each of the gripper portions having opposing ends rotatably engaged with elements of the gripper assembly;

the ramp is one of a plurality of ramps of the gripper assembly;

the roller is one of a plurality of rollers of the gripper assembly, each of the rollers being engaged with one of the gripper portions in a manner allowing the roller to rotate with respect to the gripper portion, each of the gripper portions having at least one of the rollers rotatably engaged with the gripper portion; and longitudinal movement of the slider element with respect to the body causes each of the rollers to roll along one of the ramps, which in turn causes the rollers and portions of the gripper portions to move radially.

7. A gripper assembly for anchoring a tool within a passage, the gripper assembly having a movement-limiting mode in which the gripper assembly substantially prevents movement between the gripper assembly and an inner surface of the passage, and a movement-permissive mode in which the gripper assembly permits substantially free relative movement between the gripper assembly and the inner surface of the passage, the gripper assembly comprising:

an elongated mandrel configured to be longitudinally movably engaged with an elongated body of a tool;

an elongated gripper portion extending along a length of the mandrel, the gripper portion having opposing ends rotatably engaged with elements of the gripper assembly;

a slider element configured to slide longitudinally with respect to the mandrel;

a ramp; and a roller engaged with the gripper portion in a manner allowing the roller to rotate with respect to the gripper portion;

wherein longitudinal movement of the slider element with respect to the mandrel causes the roller to roll along the ramp, which in turn causes the roller and a portion of the gripper portion to move radially.

8. The gripper assembly of claim 7, wherein:

the elongated gripper portion is one of a plurality of elongated gripper portions of the gripper assembly, each of the gripper portions extending along a length of the mandrel, each of the gripper portions having opposing ends rotatably engaged with elements of the gripper assembly;

the ramp is one of a plurality of ramps of the gripper assembly;

the roller is one of a plurality of rollers of the gripper assembly, each of the rollers being engaged with one of the gripper portions in a manner allowing the roller to rotate with respect to the gripper portion, each of the gripper portions having at least one of the rollers rotatably engaged with the gripper portion; and longitudinal movement of the slider element with respect to the mandrel causes each of the rollers to roll along one of the ramps, which in turn causes the rollers and portions of the gripper portions to move radially.

9. A tool for use within a passage, comprising:

an elongated body;

a gripper assembly for anchoring the tool within the passage, the gripper assembly having a movement-limiting mode in which the gripper assembly substantially prevents movement between the gripper assembly and an inner surface of the passage, the gripper assembly also having a movement-permissive mode in which the gripper assembly allows substantially free relative movement between the gripper assembly and the inner surface of the passage, the gripper assembly comprising:

an elongated gripper portion extending along a length of the body, the gripper portion having opposing ends rotatably engaged with elements of the gripper assembly;

a slider element configured to slide longitudinally with respect to the body; and a ramp;

said gripper assembly comprising a ramp engagement portion engaged with the gripper portion in a manner allowing the ramp engagement portion to rotate with respect to the gripper portion such that there is no sliding friction between the ramp engagement portion and the ramp when the gripper assembly is in a fully expanded position;

wherein longitudinal movement of the slider element with respect to the body causes the ramp engagement portion to translate along the ramp, which in turn causes the ramp engagement portion and a portion of the gripper portion to move radially.

10. The tool of claim 9, wherein the opposing ends of the gripper portion have substantially constant radial positions as the slider element moves longitudinally with respect to the body.

11. The tool of claim 9, wherein the ramp engagement portion is engaged with a central section of the gripper portion.

12. A gripper assembly for anchoring a tool within a passage, the gripper assembly having a movement-limiting mode in which the gripper assembly substantially prevents movement between the gripper assembly and an inner surface of the passage, and a movement-permissive mode in which the gripper assembly permits substantially free relative movement between the gripper assembly and the inner surface of the passage, the gripper assembly comprising:

an elongated mandrel configured to be longitudinally movably engaged with an elongated body of a tool;

an elongated gripper portion extending along a length of the mandrel, the gripper portion having opposing ends rotatably engaged with elements of the gripper assembly;

a slider element configured to slide longitudinally with respect to the mandrel;

a ramp; and a ramp engagement portion engaged with the gripper portion in a manner allowing the ramp engagement portion to rotate with respect to the gripper portion;

wherein longitudinal movement of the slider element with respect to the mandrel causes the ramp engagement portion to translate along the ramp, which in turn causes the ramp engagement portion and a portion of the gripper portion to move radially.

13. The gripper assembly of claim 12, wherein the ramp engagement portion is engaged with the gripper portion in a manner allowing the ramp engagement portion to rotate with respect to the gripper portion such that there is no sliding friction between the ramp engagement portion and the ramp when the gripper assembly is in a fully expanded position.

* * * * *